US009166323B2

(12) United States Patent
Lampert et al.

(10) Patent No.: US 9,166,323 B2
(45) Date of Patent: Oct. 20, 2015

(54) ELECTRICAL CONNECTOR ASSEMBLY

(71) Applicant: TRAXXAS LP, Plano, TX (US)

(72) Inventors: Jon Kenneth Lampert, Allen, TX (US); Seralaathan Hariharesan, Flower Mound, TX (US); Brock Dennison, Lewisville, TX (US)

(73) Assignee: TRAXXAS LP, McKinney, TX (US)

( * ) Notice: Subject to any disclaimer, the term of this patent is extended or adjusted under 35 U.S.C. 154(b) by 0 days.

(21) Appl. No.: 14/171,568

(22) Filed: Feb. 3, 2014

(65) Prior Publication Data

US 2014/0148064 A1 May 29, 2014

Related U.S. Application Data

(63) Continuation of application No. 12/959,872, filed on Dec. 3, 2010, now Pat. No. 8,641,440, which is a continuation of application No. 12/417,792, filed on Apr. 3, 2009, now Pat. No. 7,867,038, which is a continuation of application No. 11/951,754, filed on Dec. 6, 2007, now Pat. No. 7,530,855, which is a continuation of application No. 11/736,460, filed on Apr. 17, 2007, now Pat. No. 7,374,460.

(51) Int. Cl.

| | |
|---|---|
| ***H01R 25/00*** | (2006.01) |
| ***H01R 13/187*** | (2006.01) |
| ***H01R 13/26*** | (2006.01) |
| ***H01R 13/64*** | (2006.01) |
| ***H01R 13/642*** | (2006.01) |
| *H01R 13/41* | (2006.01) |
| *H01R 13/46* | (2006.01) |

(52) U.S. Cl.

CPC ..... *H01R 13/187* (2013.01); *H01R 13/26* (2013.01); *H01R 13/64* (2013.01); *H01R 13/642* (2013.01); *H01R 13/41* (2013.01); *H01R 13/465* (2013.01)

(58) Field of Classification Search

USPC ..... 439/679, 691, 693, 680, 282, 296, 284

See application file for complete search history.

(56) References Cited

U.S. PATENT DOCUMENTS

| | | | |
|---|---|---|---|
| 2,121,338 | A | 6/1938 | Chirelstein |
| 2,203,122 | A | 6/1940 | Anderson |
| 2,838,739 | A | 6/1958 | Winkler |
| 3,091,746 | A | 5/1963 | Winkler |

(Continued)

FOREIGN PATENT DOCUMENTS

| | | |
|---|---|---|
| DE | 704 450 | 3/1941 |
| EP | 0 318 831 A2 | 6/1989 |

(Continued)

OTHER PUBLICATIONS

Clarke, Brooke; "Power Pole" web page article; Brooke Clarke, Ukiah CA, U.S.A., 2003-2006.

(Continued)

*Primary Examiner* — Phuongchi T Nguyen

(74) *Attorney, Agent, or Firm* — CARR Law Firm PLLC

(57) ABSTRACT

An electrical connector is provided comprising a female member configured to couple with male member. The female member includes a female receptacle having an opening, and a female electrode is at least partially disposed within the female receptacle. A resilient member is configured to enhance electrical connection between the female electrode and a male connector electrode.

59 Claims, 11 Drawing Sheets

(56) References Cited

U.S. PATENT DOCUMENTS

| | | | | |
|---|---|---|---|---|
| 3,145,067 | A | 8/1964 | Mishelevich et al. | |
| 3,218,599 | A | 11/1965 | Winkler | |
| 3,233,211 | A | 2/1966 | Smith | |
| 3,259,870 | A | 7/1966 | Winkler | |
| 3,273,105 | A | 9/1966 | Klassen | |
| 3,810,070 | A | 5/1974 | Ludwig | |
| 3,909,099 | A | 9/1975 | Winkler | |
| 4,018,497 | A | 4/1977 | Bulanchuk | |
| 4,083,617 | A | 4/1978 | Wyatt | |
| 4,342,498 | A | 8/1982 | Patton et al. | |
| 4,416,498 | A | 11/1983 | Sado et al. | |
| 4,630,876 | A | 12/1986 | Grunberg et al. | |
| 4,639,061 | A | 1/1987 | Muzslay | |
| 4,737,118 | A | 4/1988 | Lockard | |
| 4,846,729 | A | 7/1989 | Hikami et al. | |
| 4,990,099 | A | 2/1991 | Marin et al. | |
| 5,533,915 | A | 7/1996 | Deans | |
| 5,575,674 | A | 11/1996 | Davis et al. | |
| 5,882,212 | A | 3/1999 | McHugh et al. | |
| 5,921,809 | A | 7/1999 | Fink | |
| 6,268,564 | B1 | 7/2001 | Miyakoshi | |
| 6,488,546 | B2 | 12/2002 | Sakurai et al. | |
| 6,619,995 | B1 | 9/2003 | Hayashi et al. | |
| 6,619,996 | B2 | 9/2003 | Hara et al. | |
| 6,623,309 | B2 | 9/2003 | Sakurai et al. | |
| 6,645,003 | B2 | 11/2003 | Yoshida et al. | |
| 6,790,067 | B2 * | 9/2004 | Douty et al. | 439/284 |
| 6,994,596 | B2 | 2/2006 | Katsuma et al. | |
| 7,004,795 | B2 | 2/2006 | Mancini et al. | |
| 7,374,460 | B1 | 5/2008 | Hariharesan et al. | |
| 7,530,855 | B2 | 5/2009 | Hariharesan et al. | |
| 7,867,038 | B2 | 1/2011 | Hariharesan et al. | |
| 8,641,440 | B2 | 2/2014 | Hariharesan et al. | |
| 2004/0127104 | A1 | 7/2004 | Stefaniu et al. | |
| 2007/0010113 | A1 | 1/2007 | Fukatsu et al. | |
| 2007/0059970 | A1 | 3/2007 | Ichio et al. | |

FOREIGN PATENT DOCUMENTS

| | | | |
|---|---|---|---|
| EP | 0 887 896 | A2 | 12/1998 |
| FR | 1036107 | | 9/1953 |
| GB | 2076599 | | 12/1981 |
| JP | 61-23274 | U | 2/1986 |
| JP | S62-25477 | U | 2/1987 |
| JP | H5-87837 | U | 11/1993 |
| JP | H06-013064 | | 1/1994 |
| JP | H07-75237 | A | 3/1995 |
| JP | H11-329630 | | 11/1999 |

OTHER PUBLICATIONS

Anderson Power Products; "PP15 Powerpole Connector" data sheet; Anderson Power Products, Sterling, MA U.S.A. (admitted prior art).
Anderson Power Products, "SB Connector Family" data sheet; Anderson Power Products, Sterling, MA, U.S.A. (admitted prior art).
Anderson Power Products; "SB 50 Connector" data sheet; Anderson Power Products, Sterling, MA, U.S.A. (admitted prior art).
Anderson Power Products; "SBS 50 Connector" data sheet; Anderson Power Products, Sterling, MA. U.S.A. (admitted prior art).
Horizon Hobby; "E-flite EC3 Device & Battery Connector, Male-Female" web page; Horizon Hobby, Inc., Champaign, IL, U.S.A. 2006.
Tyco Electronics, "Hot Plug, High Current Dual CROWN CLIP Socket Connector" ELCON Products International Co., Fremont, CA U.S.A. 2000-2001.
McMaster-Carr; "Quick-Disconnect Terminals" catalog p. 724; McMaster-Carr Supply Co. (admitted prior art).
Molex; "Standard .093" web pages; Molex, Lisle IL U.S.A. (admitted prior art).
Hyperphysics, "Household Wiring—Polarized Receptacles" web page article; http://hyperphysics.phy-astr.gsu.edu/hbase/electric/hsehld.html (admitted prior art).
TRAXXAS; "REVO transmission" illustration (1 page); Traxxas LP, Plano TX U.S.A. (admitted prior art).
Deans; "Ultra Plug" photographs (3 pages); Wm. F. Deans, Paramount CA U.S.A. (admitted prior art).
MOLEX; "Standard .093" connector photographs (7 pages); Molex, Lisle IL U.S.A. (admitted prior art).
"Standard 110V electrical plugs and receptacles" photographs (5 pages) (admitted prior art).
Barajas, Jaime; "Styling Input from Jaime", Traxxas LP, Plano TX U.S.A. (confidential internal document, Jan. 23, 2007).
EP Patent Application No. 07254357.2; European Search Report, Nov. 24, 2009.
EP Patent Application No. 13176310.4; European Search Report, Sep. 2, 2013.
EP Patent Application No. 13176310.4; Extended European Search Report, Dec. 4, 2013.

* cited by examiner

ELECTRICAL CONNECTOR ASSEMBLY

CROSS-REFERENCE TO RELATED APPLICATIONS

This application is a continuation of, and claims the benefit of the filing date of, co-pending U.S. patent application Ser. No. 12/959,872 entitled ELECTRICAL CONNECTOR ASSEMBLY, filed Dec. 10, 2010, which is a continuation of U.S. patent application Ser. No. 12/417,792 entitled ELECTRICAL CONNECTOR ASSEMBLY, filed Apr. 3, 2009, now U.S. Pat. No. 7,867,038, which is a continuation of U.S. patent application Ser. No. 11/951,754 entitled ELECTRICAL CONNECTOR ASSEMBLY, filed Dec. 6, 2007, now U.S. Pat. No. 7,530,855, which is a continuation of U.S. patent application Ser. No. 11/736,460 filed Apr. 17, 2007, now U.S. Pat. No. 7,374,460.

BACKGROUND OF THE INVENTION

1. Field of the Invention

The present invention generally relates to electrical connectors and, more particularly, to high current electrical connectors with protection against reverse polarity connections.

2. Description of the Related Art

A wide variety of electronic devices are powered through the use of battery packs. For example, remotely controlled vehicles of all types may have an on-board rechargeable battery pack supplying stored electricity to an electric motor. In some of these lightweight vehicles, racing creates a demand for more powerful motors along with increasing levels of current capacity to energize the motors. As a battery pack is drained of the stored energy contained therein, a user must be able to easily exchange a depleted battery pack for a fully charged one. The depleted battery pack is then connected to a battery charger in order to be ready for the next exchange. Consequently, there exists a need for a high current electrical connector with a lightweight and compact design.

SUMMARY OF THE INVENTION

In accordance with an embodiment of the present invention, an electrical connector having a lightweight and compact design is provided wherein a resilient member is configured to enhance electrical connection between a female electrode and a male connector electrode.

BRIEF DESCRIPTION OF THE DRAWINGS

For a more complete understanding of the present invention and the advantages thereof, reference is now made to the following Detailed Description taken in conjunction with the accompanying drawings, in which.

DETAILED DESCRIPTION

In the following discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, details concerning well known features and elements have been omitted inasmuch as such details are not considered necessary to obtain a complete understanding of the present invention, and are considered to be within the understanding of persons of ordinary skill in the relevant art.

Figure 1:
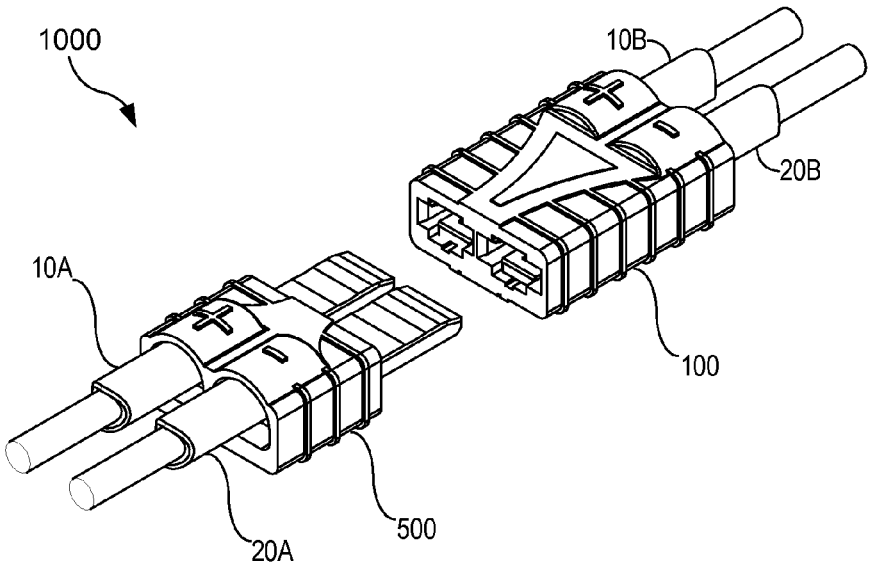
FIG. 1 illustrates a general orthogonal top view of an embodiment of an electrical connector configured according to the present invention and showing attached wire conductors.

Turning now to the drawings, FIG. 1 shows a top orthogonal view of an assembled electrical connector with attached wire conductors. In this drawing, reference numeral 1000 generally indicates an illustrative embodiment of an electrical connector 1000 at least partially configured according to the present invention. The electrical connector 1000 may comprise a female member 100 and a male member 500. Attached to the electrical connector 1000 are wire conductors 10A, 10B, 20A, and 20B. The wire conductors 10A, 10B, 20A, and 20B, may not considered as components of the electrical connector 1000 and are shown for the purposes of illustration. Wire conductors 10A and 10B may carry a positive current flow and wire conductors 20A and 20B may carry a negative current flow. The various components of the electrical connector 1000 will be described in more detail in the following illustrative embodiment.

Figure 2:
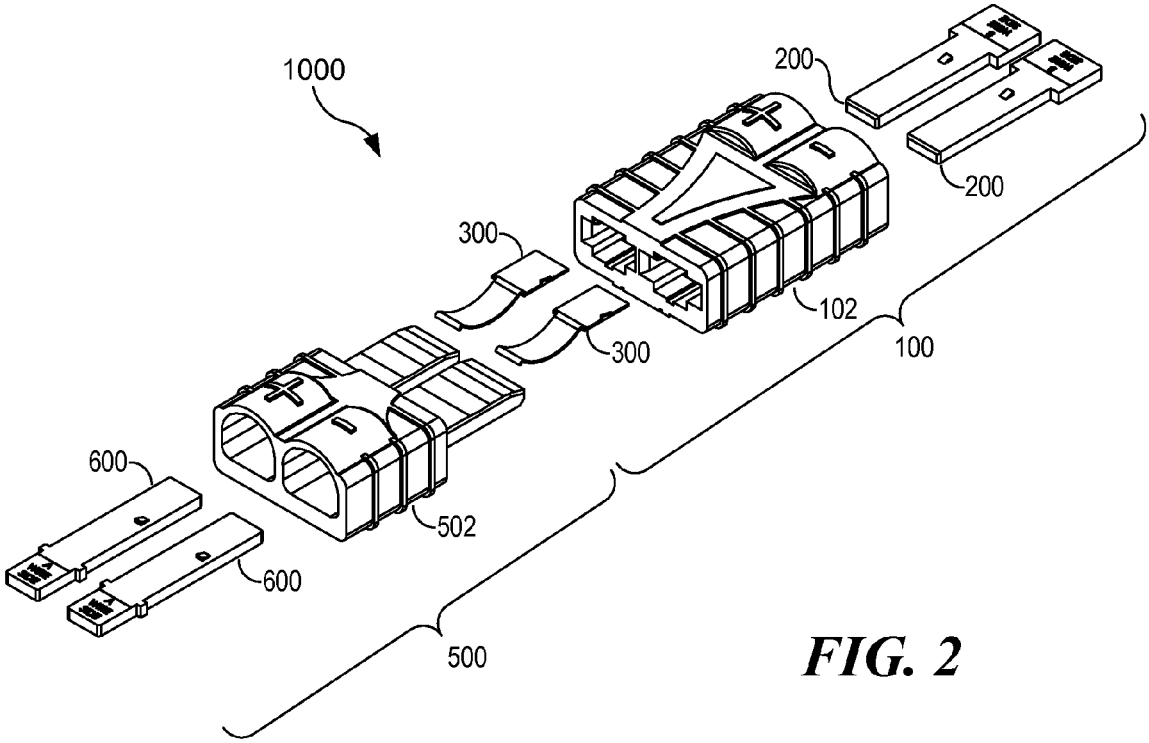
FIG. 2 illustrates an exploded assembly view of the electrical connector of FIG. 1.

Referring to FIG. 2, the components of an embodiment of the electrical connector 1000 are shown in an exploded assembly view. The female member 100 may comprise a female housing 102, a first and second female terminal 200, and a first and second resilient member 300. The male member 500 may comprise a male housing 502, and a first and second male terminal 600.

Female Member

Figure 3A:
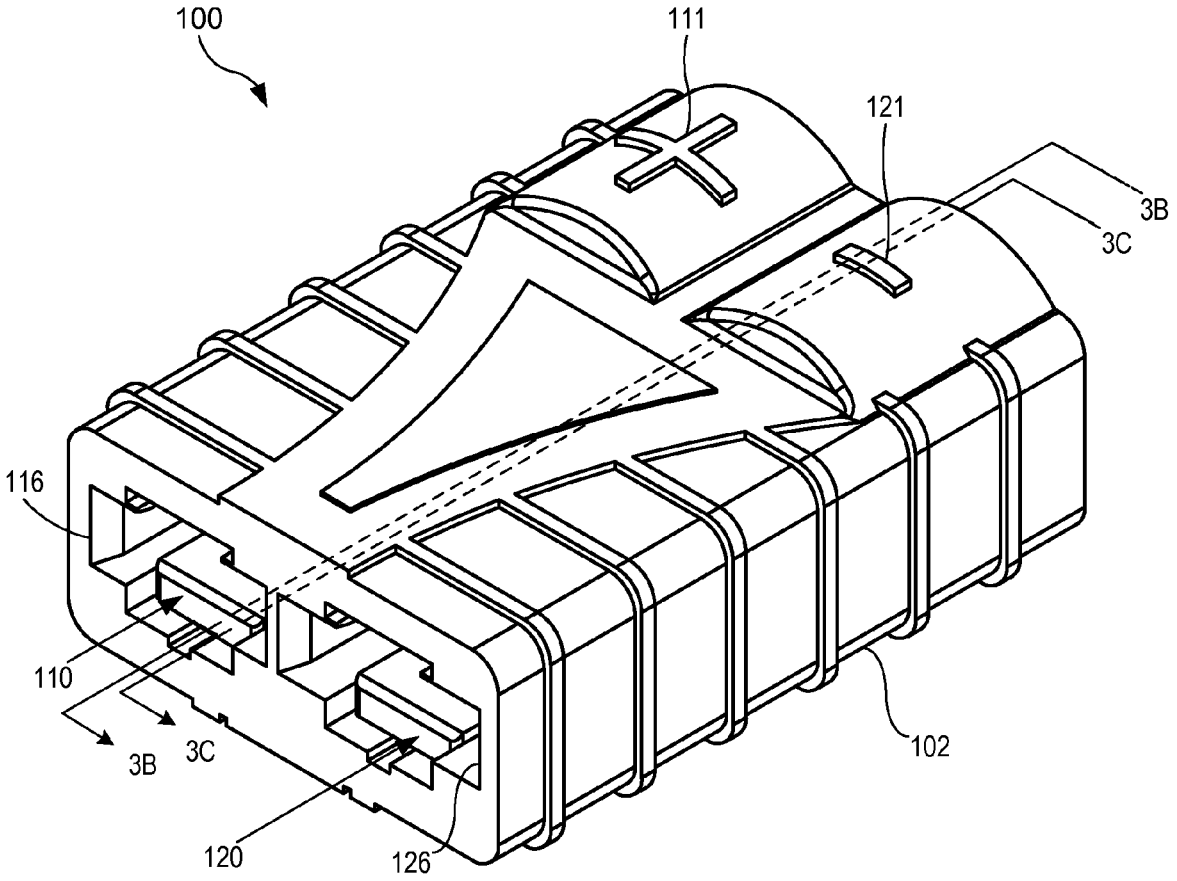
FIG. 3A illustrates an orthogonal top view of a female member of the electrical connector of FIG. 1.
Figure 3B:
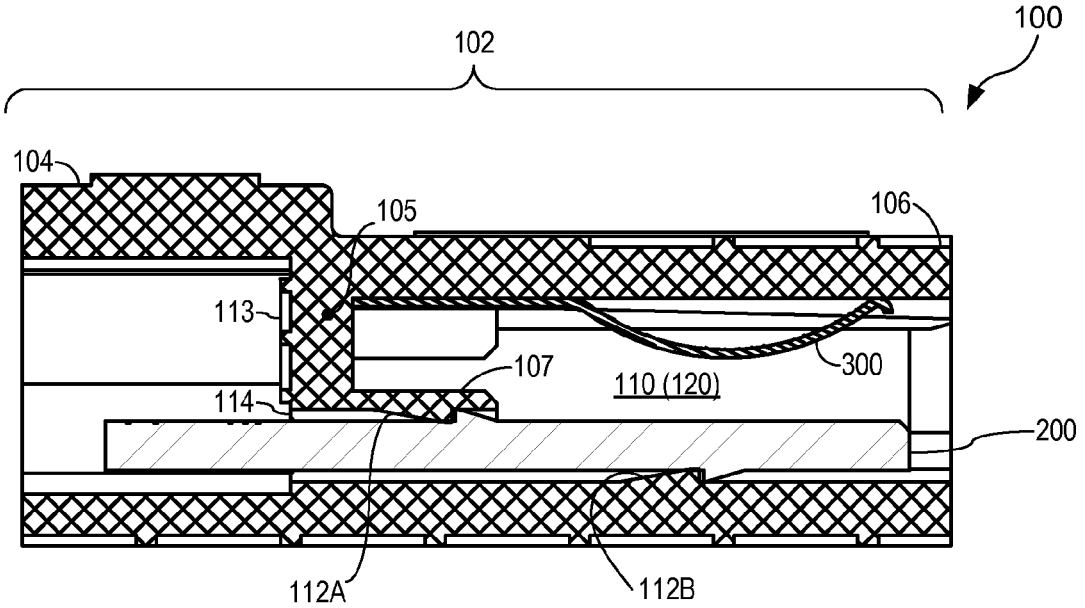
FIG. 3B illustrates a cross-sectional view of the female member of FIG. 3A as viewed along line 3B-3B.
Figure 3C:
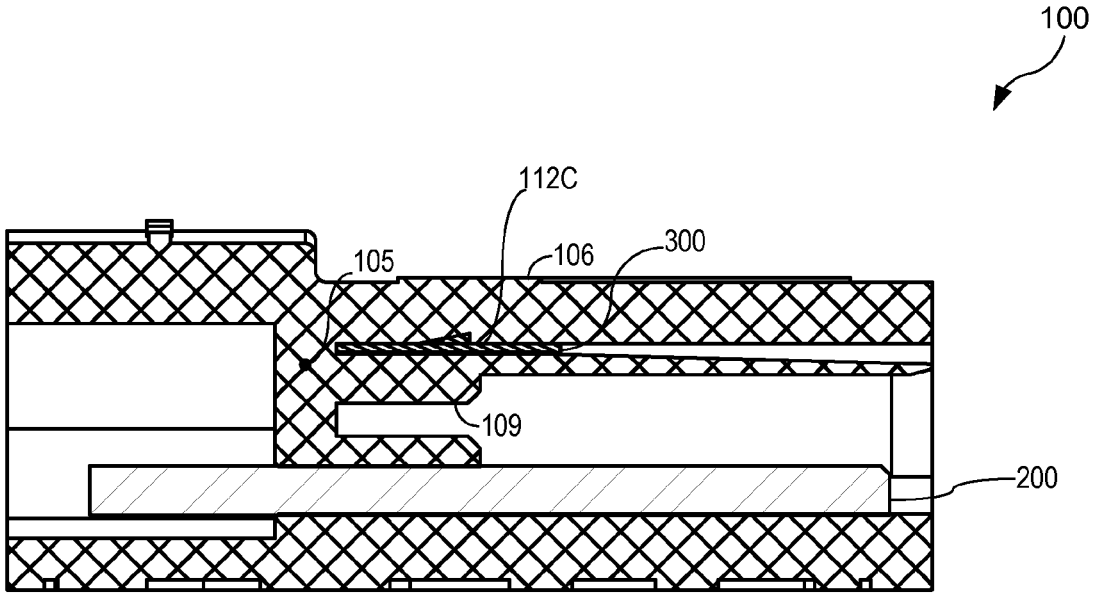
FIG. 3C illustrates a cross-sectional view of the female member of FIG. 3A as viewed along line 3C-3C.

Turning now to FIGS. 3A, 3B, and 3C, the female member 100 may comprise a female housing 102, a first female terminal chamber 110, a second female terminal chamber 120, female terminals 200, and resilient members 300 (more clearly shown in FIG. 2). A first female polarity indicator 111 and a second female polarity indicator 121 may indicate the respective polarities of the first female terminal chamber 110 and the second female terminal chamber 120. A first orifice 116 and a second orifice 126 may be located at an end of the female member 100 opposite to the first and second female polarity indicators 111 and 121. An example of a resilient member 300 is shown in FIGS. 3B and 3C. A resilient member 300 may be located in each of the first and second female terminal chambers 110 and 120 (however, only one is shown in the FIGS. 3B and 3C for the purposes of illustration). The various components of the female member 100 will be described in more detail in the following illustrative embodiment.

Female Housing

Referring to FIG. 3B, the female housing 102 may be substantially rectangular in shape and comprise a female conductor housing 104, a female internal wall 105, and a female terminal housing 106, for each of the first and second female terminal chambers 110 and 120. Due to symmetry, only the first female terminal chamber 110 will be described from this point forward, reference numerals enclosed by parenthesis refer to the second female terminal chamber 120. Although a substantially rectangular shape is shown for the female housing 102, embodiments of the present invention may not be limited to this one configuration. Any configuration capable of accommodating one or more female terminals 200 may be used. The female housing 102 may be manufactured from a dielectric material able to withstand the operating conditions of an intended application and provide sufficient electrical insulation between the current carrying female terminals 200 (i.e., inhibiting the occurrence of electrical shorts between the female terminals 200). For example, the material of the female housing 102 may be a glass reinforced nylon such as Zytel® 70G33L, made by DuPont®. In some applications the reinforced nylon material may comprise approximately 33% glass. The material may be used in a remotely controlled vehicle operating in a natural environment for example and may experience a temperature range from below −20° F. (−29° C.) to over 250° F. (121° C.) (e.g., when operated in desert conditions over solar heated roadways, or due to battery heat, current flow, and electrical resistance).

The female conductor housing 104 may be separated from the female terminal housing 106 by the female internal wall 105. The female internal wall 105 may comprise an opening 114 (124) to accommodate a female terminal 200. On the female conductor housing 104 side of the female internal wall 105, the female internal wall 105 may comprise an indicator 113 identifying the connection side of the electrical connector 1000 (FIG. 1) for example (e.g., "A" for the female member and "B" for the male member). In other embodiments, the indicator 113 may comprise a polarity sign to be used in place of, or in addition to, the first and second female polarity indicators 111 and 121 (FIG. 3A).

The female conductor housing 104 may circumferentially surround an end of a female terminal 200 inserted into each of the first and second female terminal chambers 110 and 120. An end of the female conductor housing 104 opposing the female internal wall 105 may be open to provide access for a conductor (not shown) to contact an exposed end of a female terminal 200. In other embodiments, an end or side of the female conductor housing 104 adjacent to the female internal wall 105 may be open to provide conductor access. In the embodiment shown, the female conductor housing 104 substantially shrouds and insulates the ends of the female terminals 200 from each other. In certain other embodiments the female conductor housing 104 may only partially surround an end of a female terminal 200 in each of the first and second female terminal chambers 110 and 120.

The female terminal housing 106 portions of each of the first and second female terminal chambers 110 and 120 may comprise a female terminal support 107 and a resilient member support 109 (FIG. 3C). Each of the female terminal supports 107 may help to retain a corresponding female terminal 200 in the respective first and second female terminal chambers 110 and 120. The female terminal support 107 may comprise one or more retention members 112 (for example as represented by 112A) configured to retain a female terminal 200 after assembly into a female member 100. Although a slanted ramp type of retention member 112 is shown in FIG. 3B to facilitate an insertion type of assembly (e.g., inserting a female terminal 200 from left to right in the female housing 102 with respect to FIG. 3B), a person of ordinary skill in the art would not be limited to just this type of retention member 112. Pins, rivets, fasteners, other mechanical attachments, welding, and chemical adhesives, among other various methods may be used to secure a female terminal 200 in the female housing 102. Further, similar additional retention members 112B may be used to provide additional force to oppose the friction force generated during the assembly and disassembly of the electrical connector 1000 (FIG. 1) that may otherwise move or dislocate one or both of the female terminals 200. Other embodiments of the female member 100 may not comprise retention members 112. In some cases the female terminals 200 and resilient members 300 may be core molded into the female member 100 at the time of manufacture.

The resilient member support 109 (FIG. 3C) may secure a resilient member 300 in each of the first and second female terminal chambers 110 and 120. The resilient member support 109 is shown as proximate to the female internal wall 105. However, an embodiment of the resilient member support 109 may be located proximate to an end of the female terminal housing 106 opposite to the female internal wall 105 (i.e., the insertion end of the female terminal housing 106, for example, essentially configured 180° in a horizontal plane relative to the embodiment shown in FIG. 3B) in addition to other locations. As with the female terminal support 107, the resilient member support 109 may comprise one or more retention features 112, for example, as represented by 112C in FIG. 3C. The retention features 112 of the resilient member support 109 may comprise slanted ramp protrusions as with an embodiment of the female terminal support 107, or the retention features 112 may comprise any of the mechanical, chemical, or welding methods of fastening previously recited. The previously recited methods of retaining and/or fastening female terminals 200 and resilient members 300 are not intended to form an exhaustive list, but are merely a sampling from amongst a broad variety of retaining and fastening methods known to those of ordinary skill in the art. As with the female terminals 200, the resilient members 300 may be core molded into the female housing 102 during the production of the female housing 102.

The ends of the first and second female terminal chambers 110 and 120 located in the female terminal housing 106, opposite to the female internal wall 105, are referred to as the first and second orifices 116 and 126. Each of the first and second orifices 116 and 126 may be configured substantially in a rectangular shape as shown in FIG. 3A. However, in the illustrative embodiment shown in these figures, an aspect of the first orifice 116, such as a width, may be configured differently than the same aspect of the second orifice 126. The difference in widths may inhibit an incorrectly polarized assembly of a male member 500 (FIG. 1) with the female member 100. Although a difference in dimensional aspects such as widths may be used to inhibit reversing the polarities during connection of an electrical connector 1000 (FIG. 1) the present invention may not be limited to this method. Different configurations, devices, and dimensions may be used to facilitate the proper polar connection orientation during assembly of a male member 500 with a female member 100.

Female Terminals

Figure 4A:
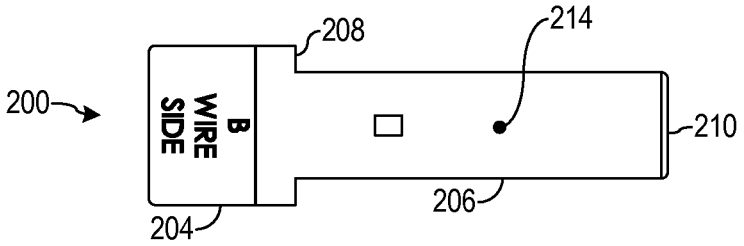
FIG. 4A illustrates a top view of a female terminal.
Figure 4B:
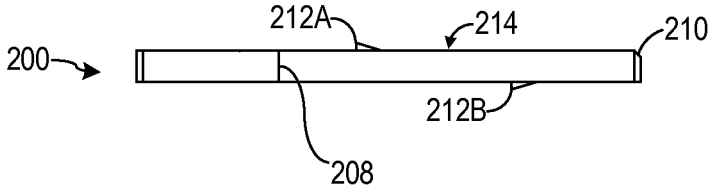
FIG. 4B illustrates a side view of the female terminal of FIG. 4A.

Turning now to FIGS. 4A and 4B, FIG. 4A shows a top view of an embodiment of a female terminal 200, and FIG. 4B shows a side view of the female terminal 200 of FIG. 4A. As an example of an illustrative embodiment of a female terminal 200, the female terminal 200 may comprise a terminal connector portion 204 and a terminal contact portion 206. The female terminal 200 may comprise an electrically conductive material, such as brass, copper, or bronze. The female terminal 200 may be plated with gold (such as a gold-cobalt or gold-nickel alloy) or silver, among other materials, preferably copper plated with nickel and then plated with gold (for example), in order to increase the electrical conductivity between contacting portions of the male and female terminals 600 and 200. The female terminal 200 shown may be made from a standard plate of material and punched formed to the correct size and configuration, among other methods of forming.

The terminal connector portion 204 may be located on one end of the female terminal 200 and configured to electrically couple with a copper wire conductor (for example) such as wire conductors 10B and 20B (FIG. 1). The terminal connector portion 204 may be electrically coupled to a wire conductor through the use of soldering, mechanical fastening (e.g., through the use of a screw clamp), standard insulated and non-insulated connector fittings, crimping, and other methods of electrically coupling a wire conductor to a portion of a terminal. Embodiments of the terminal connector portion 204 may comprise a variety of configurations in order to accommodate a particular electrical coupling method.

The terminal contact portion 206 may be located at an opposite end of the female terminal 200 relative to the terminal connector portion 204, and may comprise an angled end 210, one or more terminal retention features 212 (two are shown in FIGS. 4B, 212A and 212B), and a contact surface 214. The angled end 210 may help facilitate the coupling or assembly of a corresponding male terminal 600 (FIG. 2) during the connection of an electrical connector 1000 (FIG. 1). The contact surface 214 may directly contact an opposing surface of a male terminal 600 in order to allow an electrical current to flow from one end of the electrical connector 1000 to the other.

Terminal step 208 may separate the terminal connector portion 204 from the terminal contact portion 206. In some embodiments, during assembly of the female terminal 200 into female housing 102 (FIG. 3B), the terminal step 208 may oppose a portion of the female housing 102 and prevent further movement in the assembly direction. The terminal retention features 212 may contact corresponding retention features 112 of the female housing 102 and prevent movement in a direction opposite to the assembly direction. At this point, the female terminal 200 may be substantially securely coupled with the female housing 102.

Resilient Member

Figure 5A:
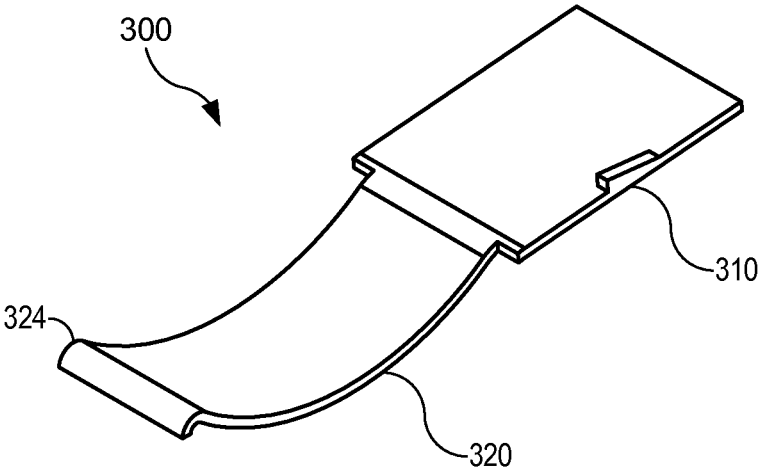
FIG. 5A illustrates an orthogonal top view of a resilient member.
Figure 5B:
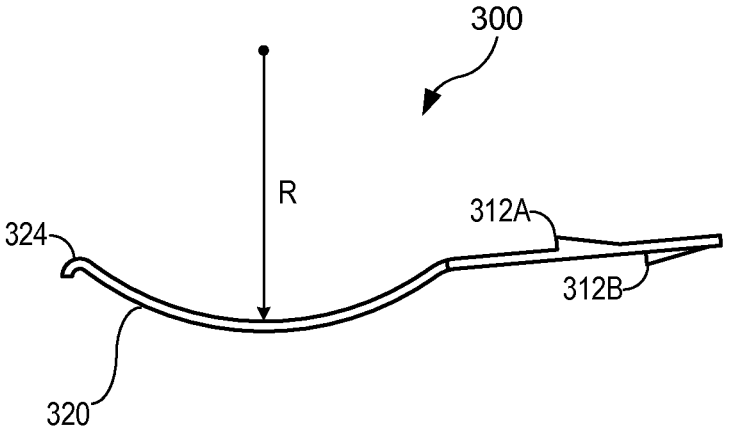
FIG. 5B illustrates a side view of the resilient member of FIG. 5A.

Referring now to FIGS. 5A and 5B, these figures respectively show an orthogonal top view of a resilient member 300 and a side view of the resilient member 300 of FIG. 5A. The resilient member 300 may comprise a resilient base member 310 and a resilient contact member 320. The resilient member 300 may be punch formed from a sheet of stainless steel (e.g., SS 301 with no plating), spring steel (e.g., spring steel with nickel plating) or other resilient material configured to work within the anticipated environmental conditions of the electrical connector 1000 (FIG. 1). In some embodiments, the resilient member 300 may be plated or otherwise coated to inhibit rust or to provide an appropriate level of resistance (e.g., friction force) necessary to maintain the connection between an assembled male member 500 and female member 100.

The resilient base member 310 may be located at one end of the resilient member 300 and comprise one or more resilient retention members 312A and 312B (FIG. 5B). The resilient retention members 312A and 312B may engage corresponding retention members 112 within the resilient member support 109 (as seen in FIG. 3C, but only one retention member 112C can be seen in this view), located in each of the first and second terminal chambers 110 and 120. The resilient retention members 312A and 312B may securely retain the resilient members 300 within the female housing 102 during assembly and disassembly of the electrical connector 1000 (FIG. 1). The resilient base member 310 is shown as a substantially flat quadrilateral but embodiments of the present invention may not be limited to this illustrative form. The resilient base member 310 may be retained separate from the corresponding female terminal 200 and separate from a fully inserted male terminal 500 (FIG. 2). In other words, the resilient base member 310 may not overlay a corresponding male terminal 500 when an electrical connector 1000 (FIG. 1) is electrically coupled.

As more easily seen in FIG. 5B, the resilient contact member 320 may comprise an arcuate portion defined by a radius R. The arcuate portion may be resiliently deformed toward the radial center point in response to pressure or interference from portions of an installed male member 500 (FIG. 1). The arcuate portion may also be configured to interface with a depression or other engaging feature, detailed later, in an opposing surface or portion of the male member 500 in order to provide a disassembly retention force after coupling the male member 500 with the female member 100 (see FIG. 1). In the illustrative embodiment shown, only a single arcuate portion is illustrated in FIGS. 5A and 5B. However, embodiments of the present invention are not to be limited to this one exemplary configuration. For example, larger and smaller radii either alone or in combination with one or more relatively straight portions may be used, an arcuate portion curving back upon the resilient contact member 320, a single angular bend joining two straight portions together, or a plurality of angular or arcuate portions such as in a zig-zag or wave type of configuration may be used in order to more evenly apply a force from the female member 100 to the male member 500. The listing is intended to provide a small representative sample of the various potential configurations consistent with the present invention and is not intended to be exhaustive.

One end of the resilient contact member 320 may comprise a housing interface 324. An example of the housing interface 324 may be illustrated by a small radius curve rotating in an opposite direction relative to the arcuate portion defined by the radius R. The housing interface 324 may facilitate a sliding movement along a contacting portion of an inner wall of the female housing 102 (FIG. 3B) in response to assembly and disassembly of a male member 500 and a female member 100 (see FIG. 2). The sliding contact may prevent or inhibit the abrading or prematurely wearing down of the inner surface of the female housing 102 over a multiple number of connections and disconnections of the electrical connector 1000 (FIG. 1). In this example, the contacting portion of the housing interface 324 curves away from the inner surface of the female housing 102 in directions tangent to the small radius curve. Further, the resilient contact member 320 may extend at an angle from the resilient base member 310 such that the housing interface 324 may be located above (with respect to FIG. 5B) a plane containing the resilient base member 310. This configuration may apply a pre-load to an assembled resilient member 300 via the housing interface 324. By adjusting the angle for the resilient contact member 320 relative to the resilient base member 310, and/or adjusting the radius R, the force applied to the male member 500 through the resilient contact member 320 may be adjusted. Adjusting the force of the resilient contact member 320 may adjust the amount of insertion and withdrawal force for the connecting and disconnecting of the electrical connector 1000. Consequently, a desired amount of insertion and withdrawal force may be established for the connecting and disconnecting of the electrical connector 1000.

Male Member

Figure 7A:
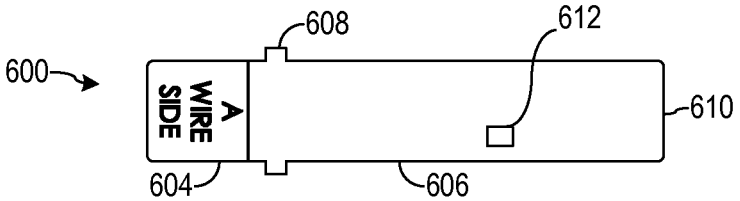
FIG. 7A illustrates a top view of a male terminal.
Figure 7B:
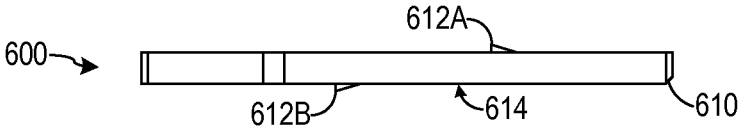
FIG. 7B illustrates a side view of the male terminal of FIG. 7A.
Figure 6A:
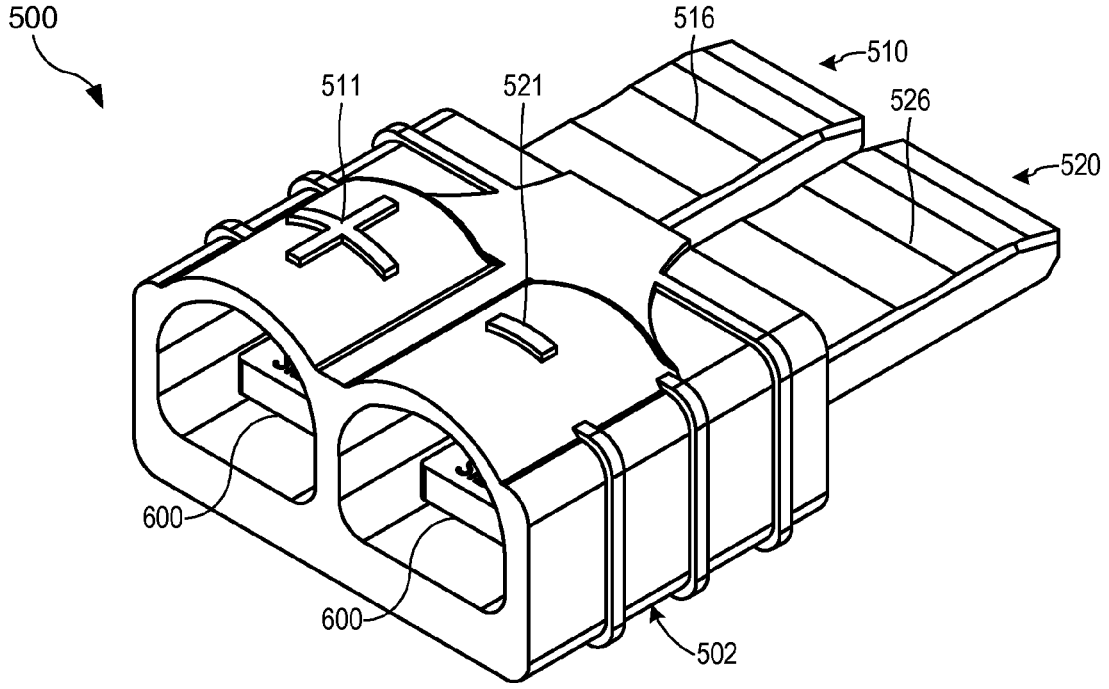
FIG. 6A illustrates an orthogonal top view of a male member.
Figure 6B:
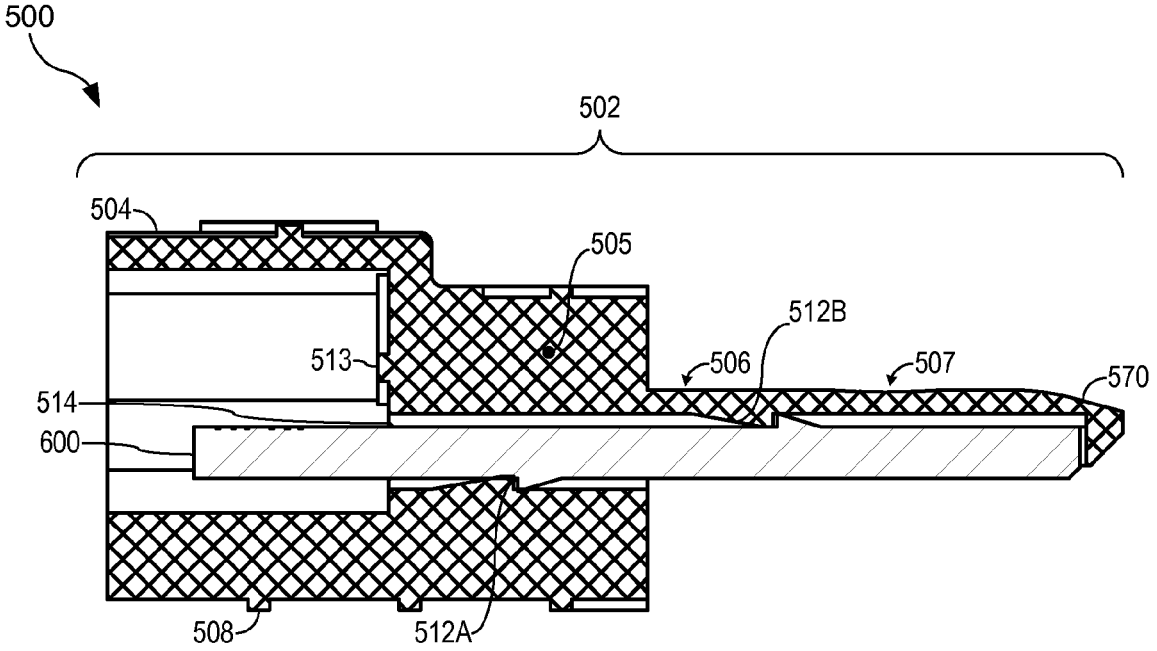
FIG. 6B illustrates a cross-sectional side view of the male member of FIG. 6A.

Turning now to FIGS. 6A, and 6B, the male member 500 may comprise a male housing 502, a first male terminal extension 510, a second male terminal extension 520, and male terminals 600 (more clearly shown in FIG. 6B). A first male polarity indicator 511 and a second male polarity indicator 521 may indicate the respective polarities of the first male terminal extension 510 and the second male terminal extension 520. An example of a male terminal 600 is shown in FIGS. 7A and 7B and is detailed later. The various components of the male member 500 will be described in more detail in the following illustrative embodiment.

Male Housing

Referring to FIG. 6B, the male housing 502 may be substantially rectangular in shape and comprise a male conductor housing 504, a male internal wall 505, and a male terminal tip 506 for each of the first and second male terminal extensions 510 and 520. Due to their similarities, only the first male terminal extension 510 will be described from this point forward, reference numerals enclosed by parenthesis refer to second male terminal extension 520. Although a substantially rectangular shape is shown for the male housing 502, embodiments of the present invention may not be limited to this one configuration. Any configuration capable of accommodating one or more male terminals 600 may be used. The male housing 502 may be manufactured from a dielectric material able to withstand the operating conditions of an intended application and provide sufficient electrical insulation between the current carrying male terminals 600 (i.e., inhibiting the occurrence of an electrical short between the male terminals 600). For example, the material of the male housing 502 may be a glass reinforced nylon such as Zytel® 70G33L, made by DuPont®. In some applications the reinforced nylon material may comprise approximately 33% glass. The material may be used in a remotely controlled vehicle operating in a natural environment for example and may experience a temperature range from below −20° F. (−29° C.) to over 250° F. (121° C.) (e.g., when operated in desert conditions over solar heated roadways, or due to battery heat, current flow, and electrical resistance).

The male conductor housing 504 may be separated from the male terminal housing 506 by the male internal wall 505. The male internal wall 505 may comprise an opening 514 (524) to accommodate a male terminal 600. On the male conductor housing 504 side of the male internal wall 505, the male internal wall 505 may comprise an indicator 513 identifying the connection side of the electrical connector 1000 (FIG. 1), for example (e.g., "A" for the female member and "B" for the male member). In other embodiments, the indicator 513 may comprise a polarity sign to be used in place of, or in addition to, the first and second male polarity indicators 511 and 521 (FIG. 6A).

The male conductor housing 504 may circumferentially surround an end of a male terminal 600 inserted into each of the first and second male terminal extensions 510 and 520. An end of the male conductor housing 504 opposing the internal wall 505 may be open to provide access for a conductor (not shown) to contact an exposed end of a male terminal 600. In other embodiments, an end or side of the male conductor housing 504 adjacent to the male internal wall 505 may be open to provide conductor access. In the embodiment shown, the male conductor housing 504 substantially shrouds and insulates the ends of the male terminals 600 from each other. In certain other embodiments the male conductor housing 504 may only partially surround an end of a male terminal 600 in each of the first and second male terminal extensions 510 and 520.

The male internal wall 505 of each of the first and second male terminal extensions 510 and 520 may function as a male terminal support (FIG. 6B). Each of the male terminal supports (i.e., male internal walls 505) may help to retain a corresponding male terminal 600 in the respective first and second male terminal extensions 510 and 520. The male terminal support may comprise one or more retention members 512 (for example as represented by 512A), configured to retain a male terminal 600 after assembly into a male member 500. Although a slanted ramp type of retention member 512 is shown in FIG. 6B to facilitate an insertion type of assembly (e.g., inserting a male terminal 600 from the left to the right in the male housing 502 with respect to FIG. 6B), a person of ordinary skill in the art would not be limited to just this type of retention member 512. Pins, rivets, fasteners, other mechanical attachments, welding, and chemical adhesives, among other various methods may be used to secure a male terminal 600 within the male housing 502. Further, similar additional retention members 512B may be used to provide additional force to oppose the friction force generated during the connection and disconnection of the electrical connector 1000 (FIG. 1) that may otherwise move or dislocate one or both of the male terminals 600. Other embodiments of the male member 500 may not comprise retention members 512. In some cases the male terminals 600 may be core molded into the male housing 502 at the time of manufacture.

The ends of the first and second male terminal extensions 510 and 520 in the male terminal tips 506, opposite to the internal wall 505, are referred to as the first and second male terminal covers 516 and 526. Each of the first and second male terminal covers 516 and 526 may be configured substantially in a rectangular shape as shown in FIG. 6A. However, in the illustrative embodiment shown in these figures, an aspect of the first male terminal cover 516, for example width, may be configured differently than the same aspect of the second male terminal cover 526. The difference in widths may inhibit an incorrectly polarized assembly of a male member 500 (FIG. 1) with the female member 100. Although a difference in dimensional aspects such as widths may be used to inhibit reversing the polarities during connection of an electrical connector 1000 (FIG. 1), the present invention may not be limited to this method. Different configurations, devices, and dimensions may be used to facilitate the proper polar connection orientation during assembly of a male member 500 with a female member 100.

The first and second male terminal covers 516 and 526 may each comprise a connector retention feature 507. In some embodiments, the connector retention feature 507 may be configured as an arcuate cavity or depression corresponding to an arcuate portion of the resilient contact member 320 of a resilient member 300 (see FIG. 5B). As the male member 500 is connected to the female member 100 (see FIG. 1), the resilient member 300 moves relative to a surface of the corresponding first and second male terminal covers 516 and 526 until a portion of the resilient contact member 320 engages a corresponding portion of the connector retention feature 507. The engagement between the resilient contact member 320 and the connector retention feature 507 may provide a sensory indication that the male member 500 is fully connected to the female member 100. In addition, the engagement between the resilient contact member 320 and the connector retention feature 507 may help to prevent inadvertent disconnection between the male member 500 and the female member 100 during the operation of the electrical connector 1000 in an applied device.

The first and second male terminal covers 516 and 526 may further comprise an angled or slanted portion 570, which may be located at an end opposite to the male internal wall 505. The slanted portion 570 of each of the first and second male terminal covers 516 and 526 may facilitate the insertion and/or assembly of the male member 500 with the female member 100 (see FIG. 1). In some embodiments, rounded, arcuate, or other insertion facilitating features may be used in place of, or in addition to, the slanted portion 570 of each of the first and second male terminal covers 516 and 526. At least part of the remaining portions of the first and second male terminal covers 516 and 526 may provide a contact surface for the resilient member 300, as previously explained, and may provide a degree of insulation between the resilient members 300 and the male terminals 600. The material of the first and second male terminal covers 516 and 526 may be the same as the material used for the rest of the male housing 502. In some embodiments, the first and second male terminal covers 516 and 526 may comprise a coating applied to a surface of the male terminals 600. Alternatively, a coating or texture may be applied to a surface of the first and second male terminal covers 516 and 526 to vary the level of frictional resistance between the surface and the contacting portion of the resilient contact member 320 of each of the respective resilient members 300.

Male Terminals

Turning now to FIGS. 7A and 7B, FIG. 7A shows a top view of an embodiment of a male terminal 600, and FIG. 7B shows a side view of the male terminal 600 of FIG. 7A. As an example of an illustrative embodiment of a male terminal 600, the male terminal 600 may comprise a terminal connector portion 604 and a terminal contact portion 606. The male terminal 600 may comprise an electrically conductive material, such as brass, copper, or bronze. The male terminal 600 may be plated with gold (such as gold-cobalt or gold-nickel alloy) or silver, among other materials, preferably copper plated with nickel and then plated with gold (for example), in order to increase the electrical conductivity between contacting portions of the male and female terminals 600 and 200. The male terminal 600 shown may be made from a standard plate of material and punched formed to the correct size and configuration, among other methods of forming.

The terminal connector portion 604 may be located on one end of the male terminal 600 and configured to electrically couple with a copper wire conductor (for example) such as wire conductors 10A and 20A (FIG. 1). The terminal connector portion 604 may be electrically coupled to a wire conductor through the use of soldering, mechanical fastening (e.g., through the use of a screw clamp), standard insulated and non-insulated connector fittings, crimping, and other methods of electrically coupling a wire conductor to a terminal. Embodiments of the terminal connector portion 604 may comprise a variety of configurations in order to accommodate a particular electrical coupling method.

The terminal contact portion 606 may be located at an opposite end of the male terminal 600 relative to the terminal connector portion 604, and may comprise an angled end 610, one or more terminal retention features 612 (two are shown in FIGS. 7B, 612A and 612B), and a contact surface 614. The angled end 610 may help facilitate the coupling or assembly of a corresponding female terminal 200 (FIG. 2) during the connection of an electrical connector 1000 (FIG. 1). The contact surface 614 may directly contact an opposing surface of a female terminal 200 in order to allow an electrical current to flow from one end of the electrical connector 1000 to the other.

Terminal step 608 may separate the terminal connector portion 604 from the terminal contact portion 606. In some embodiments, during assembly of the male terminal 600 into male housing 502 (FIG. 6B), the terminal step 608 may oppose a portion of the male housing 502 and prevent further movement in the assembly direction. The terminal retention features 612 may contact corresponding retention features 512 of the male housing 502 and prevent movement in a direction opposite to the assembly direction. At this point, the male terminal 600 may be substantially securely coupled with the male housing 502.

Assembly

Figure 8A:
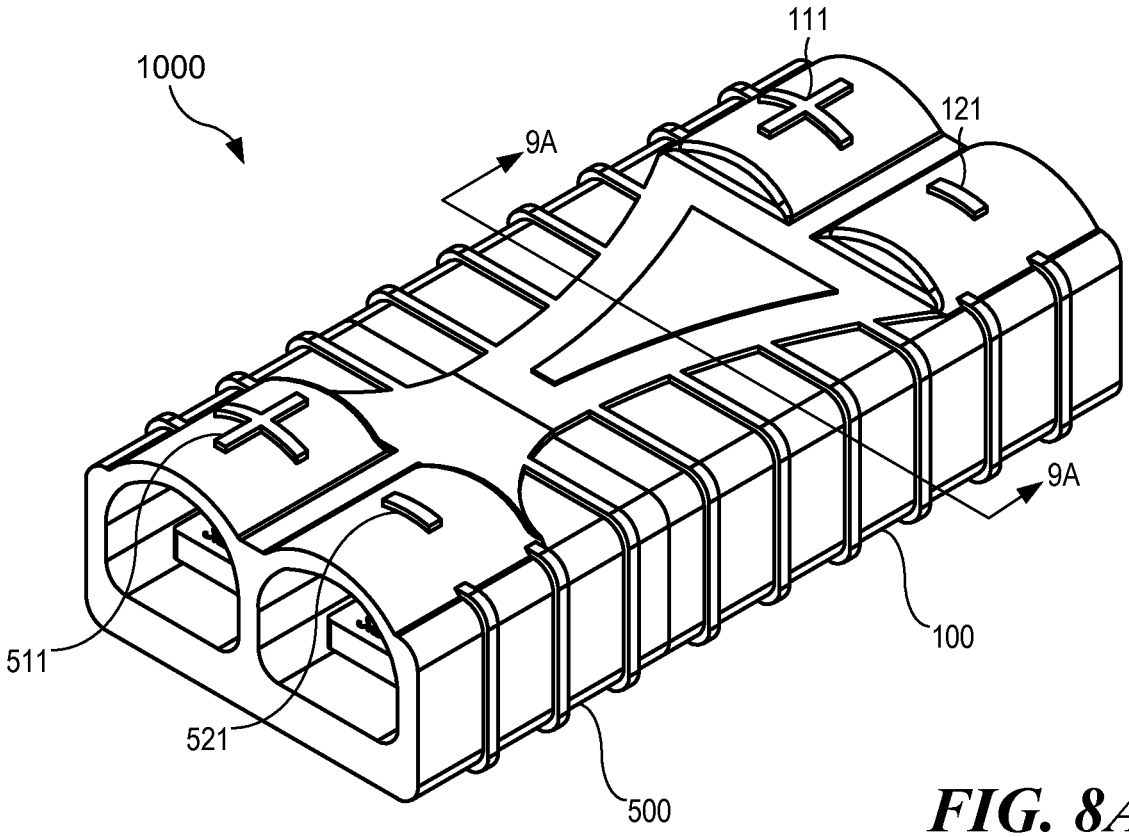
FIG. 8A illustrates an orthogonal top view of the electrical connector of FIG. 1 correctly assembled.
Figure 8B:
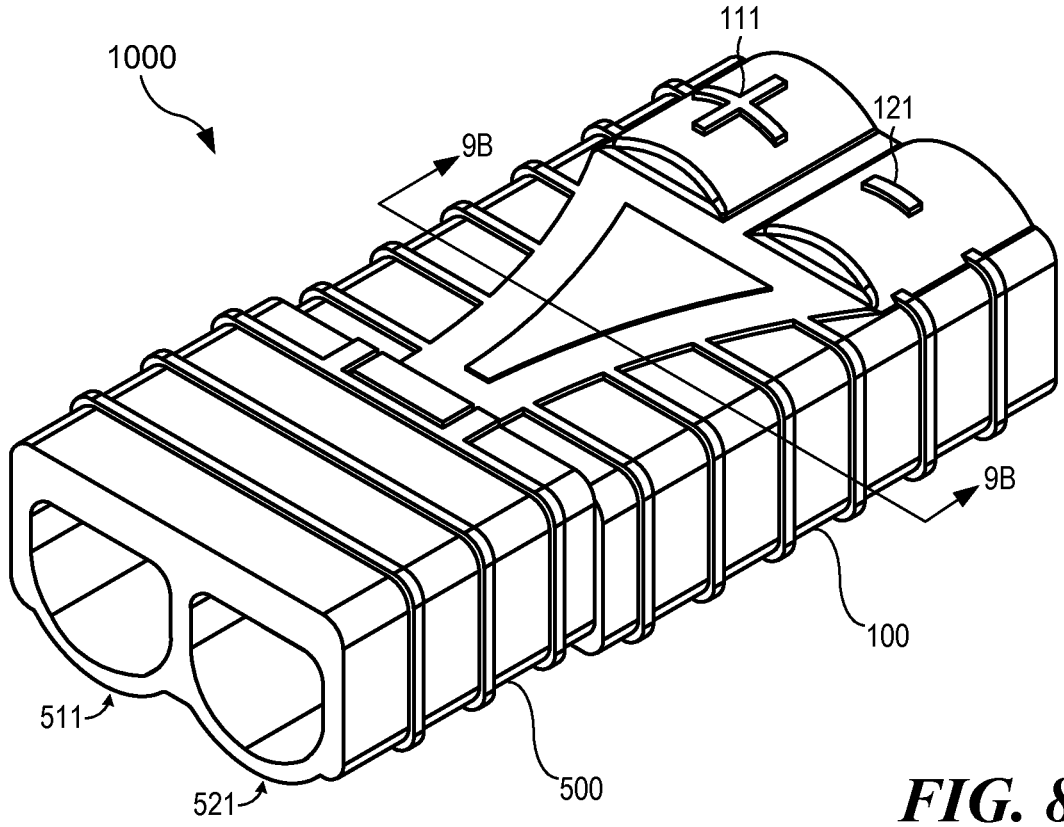
FIG. 8B illustrates an orthogonal top view of the electrical connector of FIG. 1 incorrectly assembled.

Turning now to FIGS. 8A and 8B, FIG. 8A illustrates a correctly assembled electrical connector 1000, while FIG. 8B illustrates an incorrectly assembled electrical connector 1000. As seen in FIG. 8A, when the male member 500 is correctly coupled to a female member 100, the first and second male polarity indicators 511 and 521 correspond to the first and second female polarity indicators 111 and 121, indicating the maintenance of proper polarity across the electrical connector 1000. The correspondence between the sets of polarity indicators 111, 121, 511, and 521, may provide a visual indication of the correct coupling of the male and female members 500 and 100. As seen in FIG. 8B, the first and second male polarity indicators 511 and 521 may not be visible from a top oriented viewing plane when the male member 500 is incorrectly assembled to the female member 100. In addition, as indicated by the arrows for the first and second male polarity indicators 511 and 521 (the polarity indicators themselves are not visible in this view), the polarities on each side of the incorrectly assembled electrical connector 1000 have been reversed.

Figure 9A:
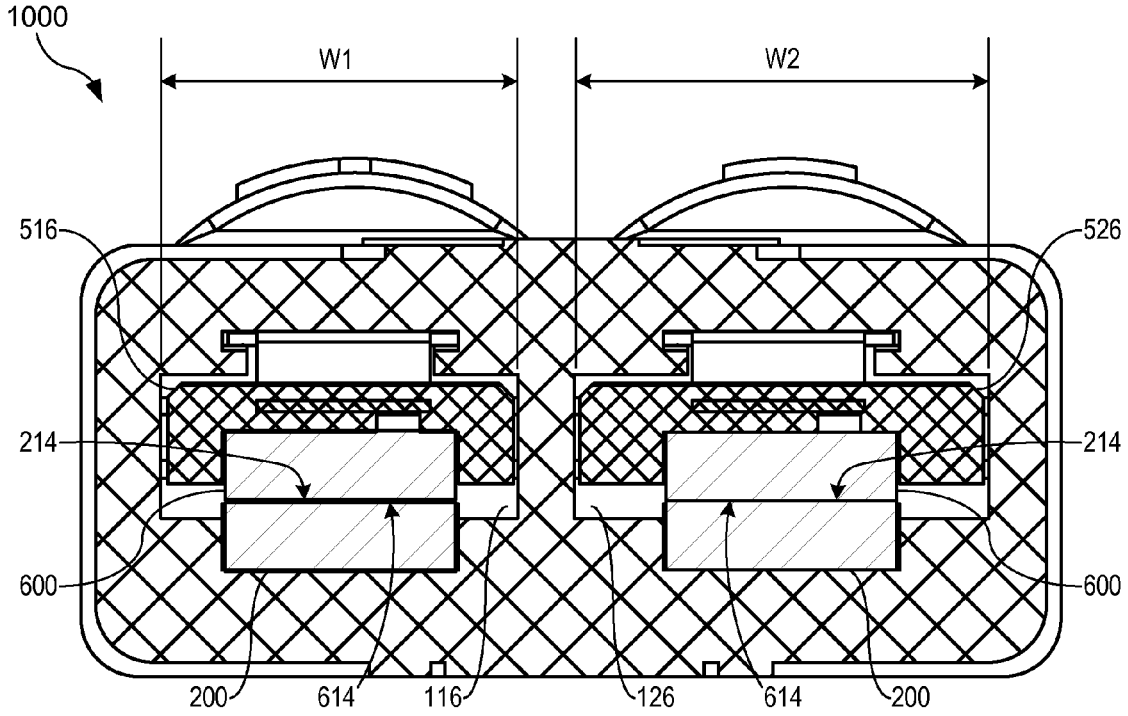
FIG. 9A illustrates a cross-sectional view of the correctly assembled electrical connector of FIG. 8A as viewed along line 9A-9A.
Figure 9B:
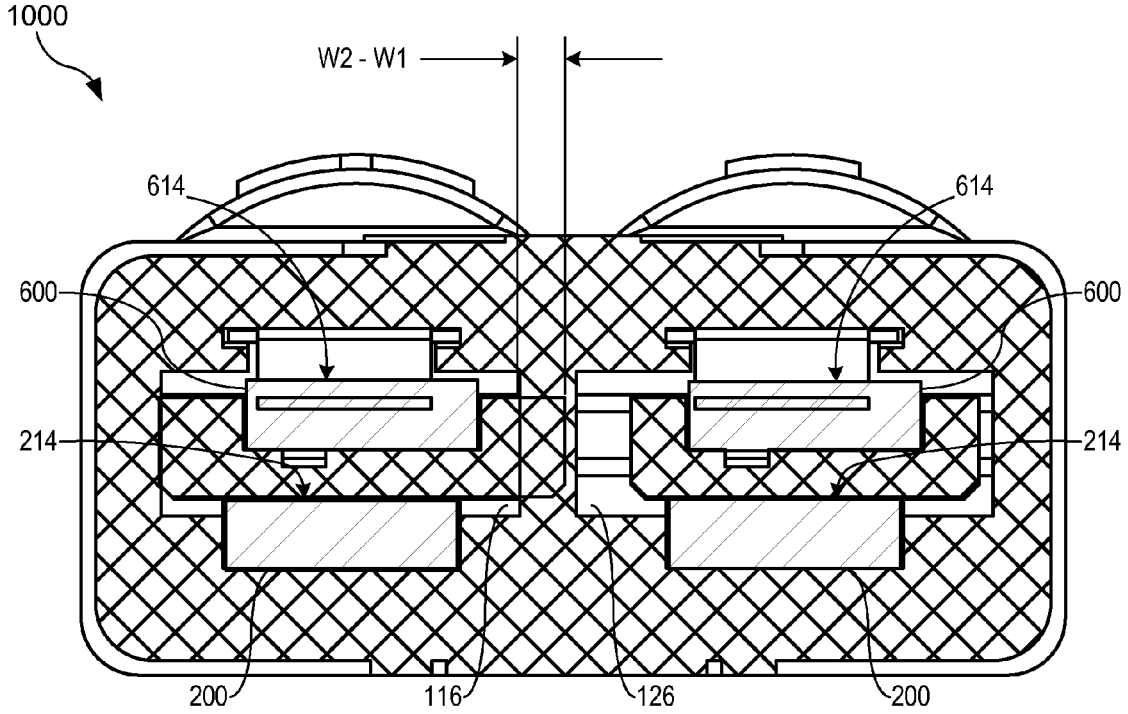
FIG. 9B illustrates a cross-sectional view of the incorrectly assembled electrical connector of FIG. 8B as viewed along line 9B-9B.

Referring to FIGS. 9A and 9B, FIG. 9A illustrates a cross-sectional view of the correctly assembled electrical connector 1000 of FIG. 8A as viewed along line 9A-9A, while FIG. 9B illustrates a cross-sectional view of the incorrectly assembled electrical connector 1000 of FIG. 8B as viewed along line 9B-9B. FIG. 9A shows an electrical connector 1000 in which a first male terminal cover 516 is inserted into a first orifice 116 and a contact surface 614 of the male terminal 600 is abutting a contact surface 214 of the female terminal 200. The first male terminal cover 516 and the first orifice 116 may each have an approximate width of W1 with the first male terminal cover 516 configured to fit within the first orifice 116. The second male terminal cover 526 is inserted into a second orifice 126 such that a contact surface 614 of the corresponding male terminal 600 is abutting a contact surface 214 of the corresponding female terminal 200. The second male terminal cover 526 and the second orifice 126 may each have an approximate width of W2 with the second male terminal cover 526 configured to fit within the second orifice 126. The width W1 may be smaller than the width W2. This difference in widths may provide another method of inhibiting or preventing cross-polarization during connection of the male member 500 to the female member 100 (FIG. 8A), since the male member 500 may be connected to the female member 100 when the male member 500 is properly oriented with respect to the female member 100. The proper orientation of the male and female members 500 and 100 may provide for the correct polarity of the connection.

FIG. 9B shows an electrical connector 1000 in which a male member 500 is incorrectly connected to a female member 100. This type of connection may be substantially prevented by the interference between the width of the second male terminal cover 526 (W2) and the width of the first orifice 116 (W1)(e.g., W2−W1). However, if the male member 500 is somehow coupled to the female member 100 in spite of this interference, cross-polarization of the electrical connector 1000 may still be prevented by the first and second male terminal covers 516 and 526 separating the male and female terminals 600 and 200. The first and second male terminal covers 516 and 526 may prevent contact between corresponding male and female terminals 600 and 200 when the male member 500 is in a second orientation with respect to the female member 100. Therefore, as seen in this illustrative embodiment, cross-polarization of the electrical connector 1000 may be prevented and/or inhibited by at least two separate and independent methods, in addition to the visual indication given by the first and second male and female polarity indicators, 111, 121, 511, and 521.

Figure 10:
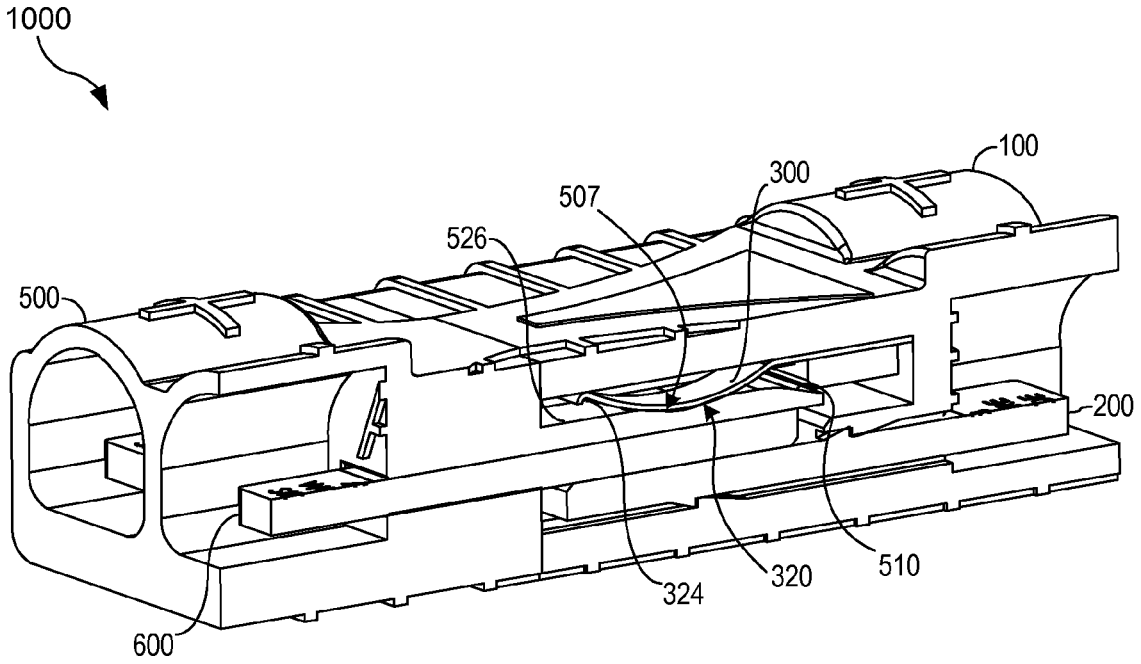
FIG. 10 illustrates an orthogonal cross-sectional view of the assembled electrical connector of FIG. 1.

Referring now to FIG. 10, this figure illustrates an orthogonal cross-sectional view of a correctly assembled male member 500 and female member 100. In this figure, the first and second male terminal extensions 510 and 520 (FIG. 6A) have been inserted into the first and second female terminal chambers 110 and 120 (FIG. 3A), or more specifically, the male terminal housing 506 portions of the first and second male terminal extensions 510 and 520 have been inserted into the first and second orifices 116 and 126 of the first and second female terminal chambers 110 and 120. As the male member 500 is connected to the female member 100, the resilient members 300 may initially contact the slanted portion 570 of the corresponding first and second male terminal covers 516 and 526. The resilient contact portions 320 may respectively slidingly engage a top surface of each of the first and second male terminal covers 516 and 526. The resilient contact portions 320 may be compressed, causing the housing interface 324 portion of the resilient member 300 to slidingly engage an interior surface of the respective first and second female terminal chambers 110 and 120. The male member 500 may continue to be inserted into the female member 100 until the resilient contact portion 320 engages a corresponding connector retention feature 507 of the respective first and second male terminal covers 516 and 526. At this point, the male member 500 may be securely coupled to the female member 100. Although only one side portion of the electrical connector 1000 is described in detail, the other side portion may be similar due to the symmetry of the connector. However, complete symmetry is not a limitation required of an embodiment of the present invention and differences beyond the widths of the first and second male terminal covers 516 and 526 and corresponding first and second orifices 116 and 126 may exist.

Another Embodiment

Figure 11:
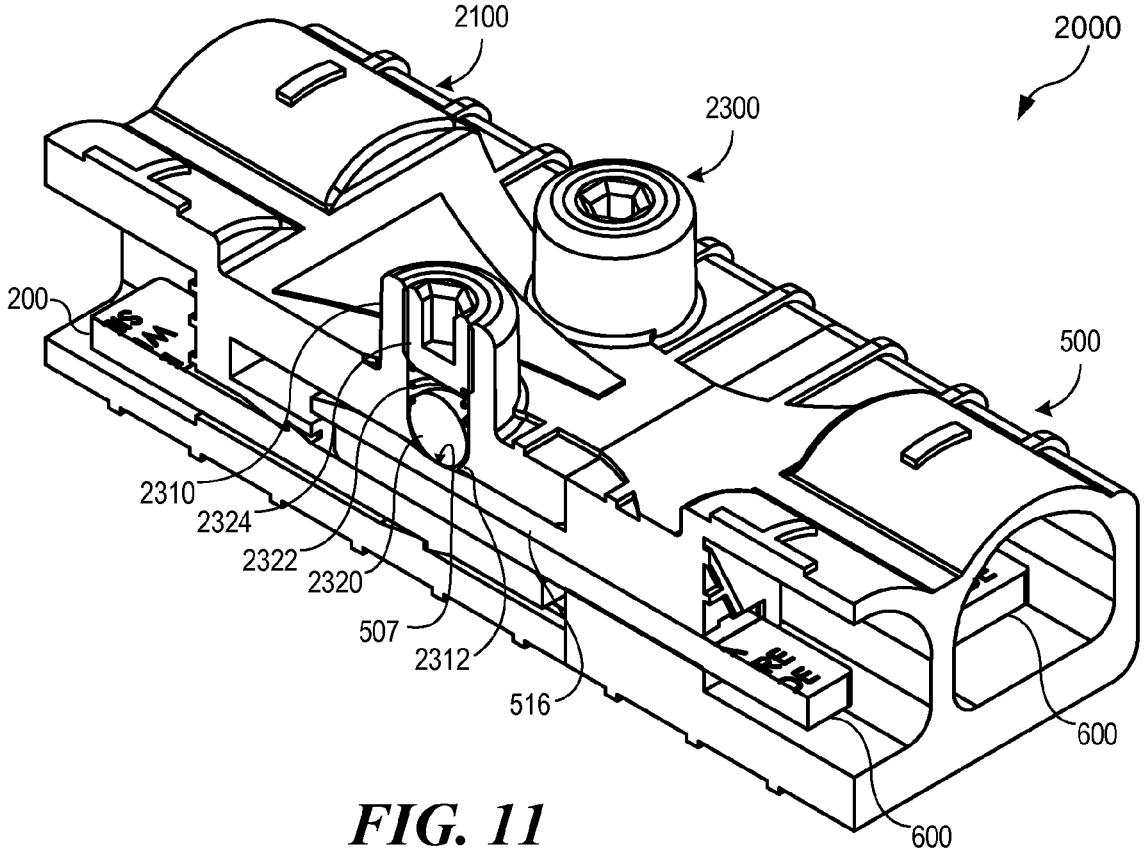
FIG. 11 illustrates an orthogonal cross-sectional top view of another embodiment of an electrical connector configured according to aspects of the present invention.

Referring now to FIG. 11, this figure shows an orthogonal top view with a cross-section taken through the side of an embodiment of an electrical connector. In this figure, reference number 2000 generally refers to another illustrative embodiment of an electrical connector 2000 constructed according to aspects of the present invention. One difference between the electrical connector 2000 and the previously described electrical connector 1000 (FIG. 1) may be the replacement of one or more resilient members 300 (FIG. 2) of the previous illustrative embodiment with one or more resilient members 2300. Otherwise, the function and materials for the two electrical connectors 1000 and 2000 may be considered to be the same. Similar components may be identified with similar reference numerals used in the previous description, and a detailed explanation of these components may not be repeated.

Electrical connector 2000 may comprise a female member 2100 and a male member 500, shown here in a connected state. The female member 2100 may comprise one or more female terminals 200 (only one is visible in this view) and the male member 500 may comprise a corresponding number of male terminals 600. When the female member 2100 and the male member 500 are coupled together, electricity may be able to flow between wire conductors (not shown) through the electrical connector 2000 via the areas of contact between the female and male terminals 200 and 600.

The female member 2100 may comprise one or more resilient members 2300. The resilient members 2300 may provide a pressing force to facilitate electrical conduction through the contact areas between the corresponding female and male terminals 200 and 600. In addition, the resilient members 2300 may provide a securing force to inhibit or prevent the inadvertent disconnection of the male member 500 from the female member 2100 during the use of the electrical connector 2300 in a desired application (e.g., such as in a vibratory and dynamic environment of a remotely controlled vehicle). In some exemplary embodiments, the number of resilient members 2300 corresponds to the number of electrical connections formed or broken during the connection and disconnection of the electrical connector 2000 (e.g., two are shown in FIG. 11). However, the number of resilient members 2300 may not be required to equal the number of electrical connections formed or broken.

Each resilient member 2300 may comprise a resilient housing 2310 integrated with the housing of the female member 2100. As shown in FIG. 11, the resilient housing 2310 may be substantially cylindrical for example, but embodiments of the present invention may not be limited to this geometric configuration. Each resilient member 2300 may further comprise a retention device 2324, a resilient device 2322, and a contact device 2320. The retention device 2324 may comprise an Allen set screw as shown for example, or may comprise any of a number of devices able to retain the resilient device 2322 and the contact device 2320 within the resilient housing 2310, while in some embodiments further providing a measure of adjustability. For example, a mechanical threaded fastener, angled key, or cam device, among others, may be used. In this example, the retention device 2324 may be threadably engaged with a top portion of the resilient housing 2310.

The resilient device 2322 may be located between the retention device 2324 and the contact device 2320. The resilient device 2322 may be a spring, such as a coil spring, or resilient material, such as foam, among other devices. The resilient device 2322 may press against the contact device 2320, facilitating movement of the contact device 2320 as the male member 500 and the female member 2100 are coupled together. The force applied to the contact device 2320 and consequently to the male and female terminals 200 and 600, may be adjusted by tightening or loosening the retention device 2324, in addition to altering the spring stiffness or material, among other methods. In some embodiments, the male member 500 may be securely coupled to the female member 2100 by tightening the retention device 2324 so as to eliminate or reduce the ability of the contact device 2320 to move within the resilient housing 2310, thereby forcefully engaging the contact device 2320 with a connector retention feature 507.

The contact device 2320 may be spherical ball for example, such as in a ball and spring type of mechanism. However, in other embodiments the contact device 2320 may be any member capable of moving across the surface of the first and second male terminal covers 516 and 526 (only the first male terminal cover 516 is visible in this view), such as a rounded pin, angled member, cylinder, among others. The contact device 2320 may be retained within the resilient housing 2310 between a protruding edge 2312 at one end and the retention device 2324 at the other end. During connection of the male member 500 and the female member 2100, the contact device 2320 may engage the connector retention feature 507 as the male member 500 is fully coupled with the female member 2100. The contact device 2320 and the connector retention feature 507 may be configured to have corresponding or interfacing features, such that when the male member 500 is fully coupled with the female member 2100, a sensory indication of the application device 2320 engaging the connector retention feature 507 may be provided. The sensory indication may be visual, audible, tactile, or a combination of one or more of these sensory indications, in addition to other methods.

Another Embodiment

Figure 12:
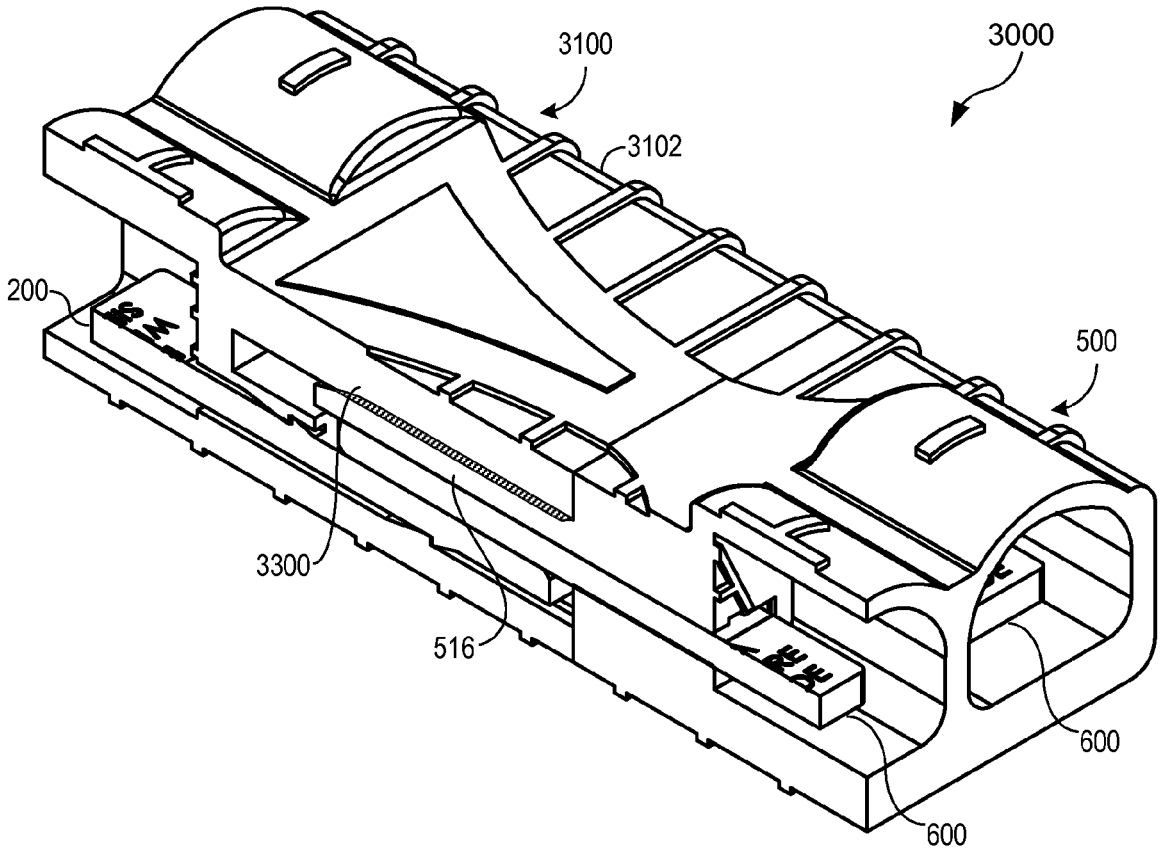
FIG. 12 illustrates an orthogonal cross-sectional top view of another embodiment of an electrical connector configured according to aspects of the present invention.

Referring now to FIG. 12, this figure shows an orthogonal top view with a cross-section taken through the side of an embodiment of an electrical connector. In this figure, reference number 3000 generally refers to another illustrative embodiment of an electrical connector 3000 constructed according to aspects of the present invention. One difference between the electrical connector 3000 and the previously described electrical connectors may be the replacement of one or more resilient members 300 (FIG. 2) or 2300 (FIG. 11) of the previous illustrative embodiments, with one or more resilient members 3300. Otherwise, the function and materials for the electrical connectors 1000, 2000, and 3000 may be considered to be the same. Similar components may be identified with similar reference numerals used in the previous description, and a detailed explanation of these components may not be repeated.

Electrical connector 3000 may comprise a female member 3100 and a male member 500, shown here in a connected state. The female member 3100 may comprise one or more female terminals 200 (only one is visible in this view) and the male member 500 may comprise a corresponding number of male terminals 600. When the female member 3100 and the male member 500 are coupled together, electricity may be able to flow between wire conductors (not shown) through the electrical connector 3000 via the contact areas between the female and male terminals 200 and 600.

The female member 3100 may comprise one or more resilient members 3300. The resilient members 3300 may provide a pressing force to facilitate electrical conduction through the contact area between the female terminals 200 and the male terminals 600. In addition, the resilient members 3300 may provide a securing force to inhibit or prevent the inadvertent disconnection of the male member 500 from the female member 3100 during the use of the electrical connector 3300 in a desired application (e.g., such as in a vibratory and dynamic remotely controlled vehicle). In some exemplary embodiments, the number of resilient members 3300 corresponds to the number of electrical connections formed or broken during the connection and disconnection of the electrical connector 3000, two electrical connections are shown in this embodiment. However, the number of resilient members 3300 may not be required to equal the number of electrical connections formed or broken.

Each resilient member 3300 may be configured to interfere with a opposing surface of a first and second male terminal cover 516 and 526 (only 516 is visible in this view) when a male member 500 is coupled to a female member 3100. As shown in FIG. 12, the area indicated by cross-hatching may be the area of interference between the resilient member 3300 and the top surface of the first male terminal cover 516, although only a portion of the abutting surfaces may be configured to be interfering. The resilient member 3300 may comprise a rib interfacing with a portion of the respective top surface of the first and second male terminal covers 516 and 526, or the resilient member 3300 may comprise the wall of the female member housing 3102, among numerous other configurations such as those previously described for the resilient contact portion 320. Essentially, in some embodiments the housing 3102 of the female member 3100 may function as a resilient member, allowing at least some degree of resilient deformation or movement designed to apply a force to at least a portion of an installed male member 500 (e.g., such as the first and second male terminal covers 516 and 526, or in some embodiments, the male terminals themselves, among other configurations). Alternatively, the first and second male terminal covers 516 and 526 may function as a resilient member, allowing at least some degree of resilient deformation or movement designed to urge the male terminals 600 together with the corresponding female terminals 200. Further, in some embodiments, both the female housing 3102 and the first and second male terminal covers 516 and 526 may experience some degree of resilient deformation, combining together to provide a force urging the male terminals 600 together with the corresponding female terminals 200.

The resilient member 3300 may further comprise protrusions or features configured to engage with corresponding depressions or features located on the top surfaces of the first and second male terminal covers 516 and 526, such that the male member 500 may be securely coupled to the female member 3000 upon fully connecting the male member 500 to the female member 3100. An example of a protrusion for the resilient member 3300 may be an arcuate ridge corresponding to the connector retention feature 507 shown in FIG. 6B. The resilient member 3300 may at least partially resiliently deform with respect to the area of interference. Alternatively, the resilient member 3300 may take advantage of at least some degree of resilient deformation in the configuration of the female member housing 3102.

Another Embodiment

Figure 13A:
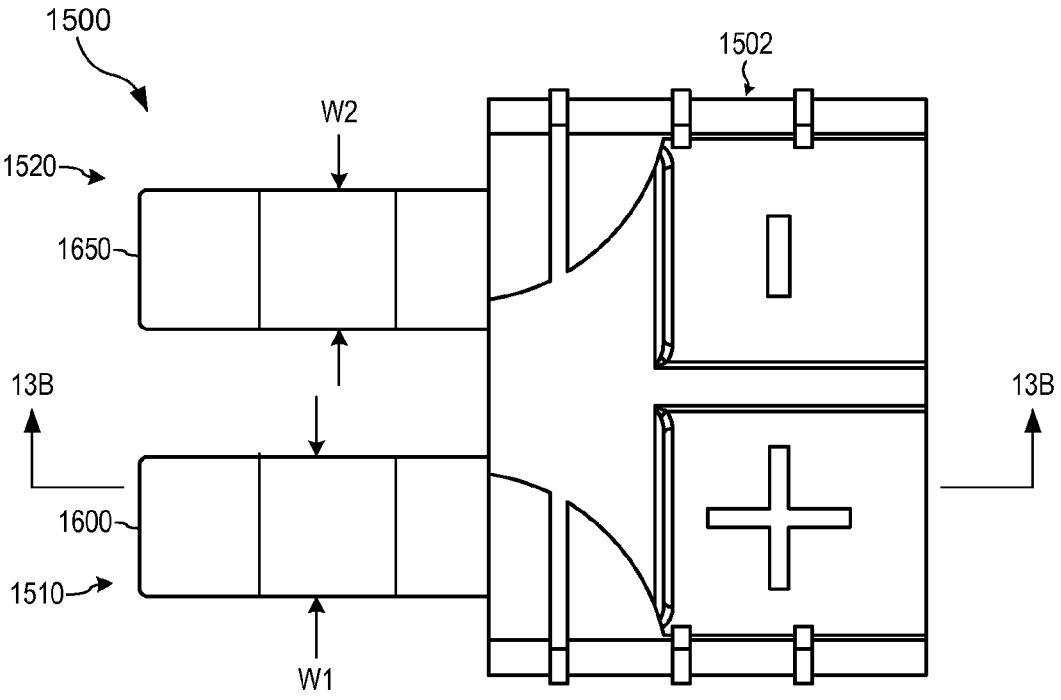
FIG. 13A illustrates a top view of another embodiment of a component of an electrical connector configured according to aspects of the present invention.
Figure 13B:
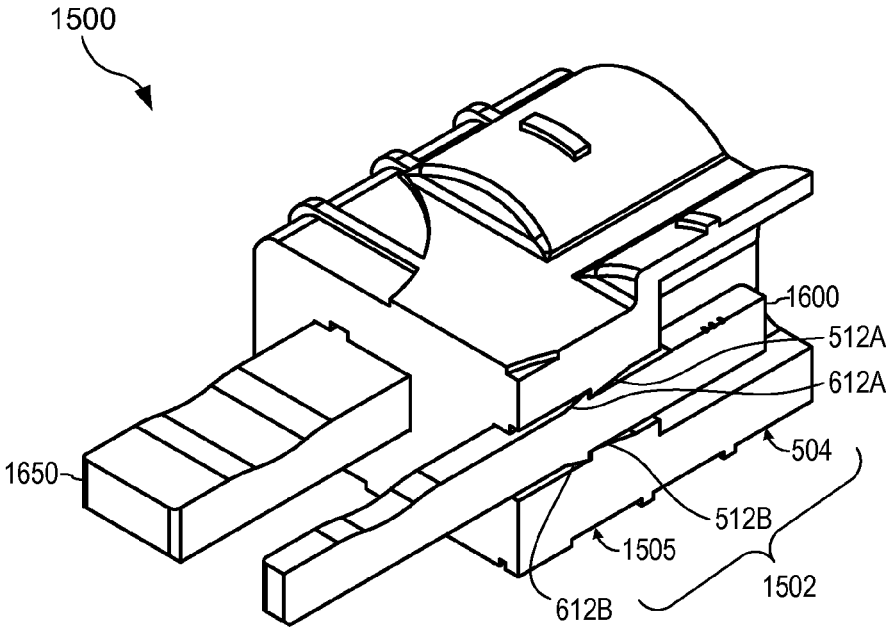
FIG. 13B illustrates an orthogonal cross-sectional top view of the component of FIG. 13A as viewed along line 13B-13B.

Turning now to FIGS. 13A and 13B, the first figure shows a top view of an illustrative embodiment of a male member 1500 configured according to aspects of the present invention, while the second figure shows an orthogonal cross-sectional top view of the male member 1500 of FIG. 13A as viewed along line 13B-13B. One difference between the male member 1500 and the previously described male member 500 (FIG. 1) may be the lack of first and second male terminal covers 516 and 526 (see FIGS. 6A and 6B) in the male member 1500. Another difference may be the use of first and second male terminals 1600 and 1650 in male member 1500 in place of the male terminals 600 shown in male member 500 (see FIG. 2). Otherwise, the function and materials for the male members 500 and 1500 may be considered to be substantially the same. Similar components may be identified with similar reference numerals used in previous descriptions, and a detailed explanation of these components may not be repeated.

Male member 1500 may comprise a male housing 1502 and first and second male terminal extensions 1510 and 1520. The first male terminal extension 1510 may comprise the first male terminal 1600, while the second male terminal extension 1520 may comprise the second male terminal 1650. First and second male terminals 1600 and 1650 may be configured to be insertably engaged with the first and second orifices 116 and 126 of the first and second female terminal chambers 110 and 120 of a female member 100 (see FIG. 3A). In some embodiments, some aspects of the first male terminal 1600 may be different than similar aspects of the second male terminal 1650 in order to inhibit the cross-polarizing connection of a male member 1500 and a female member 100. In the embodiment shown, the width W1 of the first male terminal 1600 may be smaller that the width W2 of the second male terminal 1650. Interference between the larger width W2 and the first orifice 116 may inhibit the connection between a female member 100 and an improperly oriented male member 1500 (i.e., the male member 1500 may be improperly oriented with respect to the female member 100).

The male housing 1502 may be substantially rectangular in shape and comprise a male conductor housing 504 and a male internal wall 1505 for each of the first and second male terminal extensions 1510 and 1520. Although a substantially rectangular shape is shown for the male housing 1502, embodiments of the present invention may not be limited to this one configuration. Any configuration capable of accommodating one or more first and second male terminals 1600 and 1650 may be used. The male housing 1502 may be manufactured from a dielectric material able to withstand the operating conditions of an intended application and provide sufficient electrical insulation between the current carrying first male terminal 1600 and second male terminal 1650 (i.e., inhibiting the occurrence of an electrical short between the first male terminal 1600 and the second male terminal 1650).

The male internal wall 1505 of each of the first and second male terminal extensions 1510 and 1520 may function as a male terminal support. Each of the male terminal supports (i.e., male internal walls 1505) may respectively secure and support the first and second male terminals 1600 and 1650 in the corresponding first and second male terminal extensions 1510 and 1520. The male terminal support may comprise one or more retention members 512 (for example as represented by 512A and 512B) configured to retain the respective first and second male terminals 1600 and 1650 after assembly into a male member 1500. Although a slanted ramp type of retention member 512 is shown in FIG. 13B to facilitate an insertion type of assembly (e.g., inserting a male terminal 1600 from the right to the left in the male housing 1502 with respect to FIG. 13B), a person of ordinary skill in the art would not be limited to just this type of retention member 512. Pins, rivets, fasteners, other mechanical attachments, welding, and chemical adhesives, among other various methods may be used to secure the first and second male terminals 1600 and 1650 within the male housing 1502. Additionally, the first and second male terminals 1600 and 1650 may be core molded along with the male housing 1502 at the time of manufacture.

The first and second male terminals 1600 and 1650 may comprise retention members 612 (for example as represented by 612A and 612B, however, only the retention members 612 of the first male terminal 1600 may be seen in FIG. 13B, the second male terminal 1650 may be similarly configured) corresponding to the retention members 512. As with the retention member 512, a slanted ramp type of retention member 612 is shown in FIG. 13B to facilitate an insertion type of assembly, however, a person of ordinary skill in the art would not be limited to just this type of retention member 612. Pins, rivets, fasteners, other mechanical attachments, welding, and chemical adhesives, among other various methods may be used to secure the first and second male terminals 1600 and 1650 within the male housing 1502.

Having thus described embodiments of the present invention by reference to certain exemplary embodiments, it is noted that the embodiments disclosed are illustrative rather than limiting in nature. A wide range of variations, modifications, changes, and substitutions are contemplated in the foregoing disclosure. In some instances, some features of an embodiment of the present invention may be employed without a corresponding use of the other features. Many such variations and modifications may be considered desirable by those skilled in the art based upon a review of the foregoing description of the illustrative embodiments. Accordingly, it is appropriate that the appended claims be construed broadly and in a manner consistent with the scope of the invention.

We claim:

1. A female electrical connector comprising:

a female housing comprising an insulating material at least partially forming a first female receptacle comprising a first receptacle opening for at least partially receiving a first male connector electrode;

a first female electrode disposed at least partially within the first female receptacle, wherein the first female electrode comprises a first surface for electrically coupling with a first male connector electrode;

a first resilient member retained by the first female receptacle, wherein the first resilient member comprises a first resilient contact member configured to deform while a first male connector electrode is at least partially inserted into the first female receptacle;

wherein a first end of the first resilient member further comprises a first base member fixed relative to a first portion of the female housing when a first male connector electrode is at least partially inserted into the first female receptacle between a non-inserted and fully inserted configuration and a second end of the first resilient member is moveable within the first female receptacle upon deformation while a first male connector electrode is at least partially inserted into the first female receptacle;

wherein the first resilient member is configured to provide a biasing force to facilitate an electrical coupling of the first female electrode with only a first male connector electrode;

wherein the first resilient contact member resiliently deforms in response to interference from one or more portions of a first male connector electrode, when a first male connector electrode is at least partially inserted into the first female receptacle; and wherein the first resilient member is retained within the female housing spaced from the first female electrode, whereby the first resilient member and the first female electrode are not in contact with one another.

2. The female electrical connector of claim 1, wherein the first female electrode comprises a plate of conductive material having a planar first surface.

3. The female electrical connector of claim 1, wherein the first female electrode is configured to remain fixed relative to the first base member.

4. The female electrical connector of claim 1, wherein the first female electrode extends within a first plane configured to remain fixed relative to a second plane when a first male connector electrode is at least partially inserted into the first female receptacle between an unconnected configuration and a connected configuration, wherein the first base member extends within the second plane.

5. The female electrical connector of claim 1, wherein the first resilient member is disposed within the first female receptacle on the same side of the first female electrode as the first surface.

6. The female electrical connector of claim 1, wherein the first resilient member is retained within the female housing separately from the first female electrode, whereby a first male connector electrode is disposed between the first resilient member and the first female electrode when a first male connector electrode is inserted into the first female receptacle.

7. The female electrical connector of claim 1, wherein at least a portion of the first base member is secured within the first female receptacle separately from the first female electrode such that the female housing electrically insulates the first base member from the first female electrode.

8. The female electrical connector of claim 1, wherein the first base member extends from the first resilient contact member along the direction of insertion of a first male connector electrode to at least partially into the first female receptacle.

9. The female electrical connector of claim 1, wherein the first female electrode abuts an inner surface of the first female receptacle along at least a portion of the surface of the first female electrode, with the inner surface of the first female receptacle disposed on the directly opposite side of the first female electrode from the side of the first female electrode comprising the first surface.

10. The female electrical connector of claim 1, wherein the female housing comprises a uniform insulating material.

11. The female electrical connector of claim 1, wherein the female housing comprises a single piece of material.

12. The female electrical connector of claim 1, wherein deformation of the first resilient contact member in response to interference from one or more portions of a first male connector electrode, when a first male connector electrode is at least partially inserted into within the first female receptacle, causes the first resilient member to extend in a direction substantially parallel to the direction of insertion of a first male connector electrode.

13. The female electrical connector of claim 1, wherein the first surface extends in a direction substantially parallel to the direction of insertion of a first male connector electrode to at least partially into the first female receptacle.

14. The female electrical connector of claim 1, wherein the first resilient member is not in contact with a male connector electrode unless and until a male connector electrode is at least partially inserted into within the first female receptacle.

15. The female electrical connector of claim 1, wherein the first female electrode is configured to remain fixed relative to the female housing to prevent movement away from a first male connector electrode when a first male connector electrode is at least partially inserted into the first female receptacle between a non-inserted and fully inserted configuration.

16. The female electrical connector of claim 15, wherein the first female electrode further comprises one or more anchor portions extending from the first female electrode for securing the female electrode against longitudinal movement relative to the female housing in at least one direction.

17. The female electrical connector or claim 1, wherein the second end of the first resilient member slides along at least a portion of the wall of the first female receptacle upon deformation.

18. The female electrical connector of claim 17, wherein the second end of the first resilient member comprises a bend away from the at least a portion of the wall of the first female receptacle, with the bend facilitating sliding movement of the first resilient member along the at least a portion of the wall of the first female receptacle upon deformation.

19. The female electrical connector of claim 1, wherein the first surface is planar and substantially aligned with the direction of insertion of a first male connector electrode to at least partially into the first female receptacle.

20. The female electrical connector of claim 19, wherein the first surface extends to the end of the first female electrode.

21. The female electrical connector of claim 19, wherein the first female electrode further comprises a first female connector portion, and wherein the first surface is substantially co-planar with the first female connector portion.

22. The female electrical connector of claim 1, wherein a first male connector electrode is secured within the first female receptacle by an interference fit.

23. The female electrical connector of claim 22, wherein a first male connector electrode is secured within the first female receptacle by an interference fit without substantial deformation of a surface of a first male connector electrode.

24. The female electrical connector of claim 22, wherein the first resilient contact member is configured to deform while a first male connector electrode is at least partially inserted into the first female receptacle without any substantial deformation of the female housing.

25. The female electrical connector of claim 1, wherein the first resilient contact member comprises an arcuate portion, and wherein the arcuate portion resiliently deforms in response to interference from one or more portions of a first male connector electrode, when a first male connector electrode is at least partially inserted into the first female receptacle.

26. The female electrical connector of claim 25, wherein the portions of the first surface extending substantially along the length of the first female electrode are substantially aligned with a component of displacement of the first resilient member as the first resilient member deforms.

27. The female electrical connector of claim 25, wherein the first surface is substantially normal to a component of the displacement of the first resilient member as the first resilient member deforms.

28. The female electrical connector of claim 25, wherein the first resilient member further comprises a leaf spring.

29. The female electrical connector of claim 1, further comprising:

the insulating material at least partially forming a second female receptacle comprising a second receptacle opening for at least partially receiving a second male connector electrode;

a second female electrode disposed at least partially within the second female receptacle, wherein the second female electrode comprises a second surface for electrically coupling with a second male connector electrode; and a second resilient member retained by the second female receptacle, wherein the second resilient member comprises a second resilient contact member configured deform while a second male connector electrode is at least partially inserted into the second female receptacle.

30. The female electrical connector of claim 29, wherein at least one dimension of the first receptacle opening is larger than a corresponding dimension of the second receptacle opening.

31. The female electrical connector of claim 29, wherein the second resilient member further comprises a second base member fixed relative to a second portion of the female housing when a second male connector electrode is at least partially inserted into the second female receptacle between a non-inserted and fully inserted configuration.

32. The female electrical connector of claim 29, wherein the second resilient member is configured to provide a biasing force to facilitate an electrical coupling of the second female electrode with only a second male connector electrode.

33. A female electrical connector comprising:

a female housing comprising a single piece of insulating material at least partially forming a first female receptacle comprising a receptacle opening for at least partially receiving a first male connector electrode;

a first female electrode disposed at least partially within the first female receptacle;

a first resilient member retained by the first female receptacle, wherein the first resilient member comprises a first resilient contact member configured to provide an interference fit between the first female electrode and a first male connector electrode to secure the first female electrode and a first male connector electrode, when a first male connector electrode is at least partially inserted into the first female receptacle;

wherein a first end of the first resilient member further comprises a first base member fixed relative to a first portion of the female housing when a first male connector electrode is at least partially inserted into the first female receptacle between a non-inserted and fully inserted configuration;

wherein the first resilient contact member is configured to deform while a first male connector electrode is at least partially inserted into the first female receptacle without any substantial deformation of the female housing;

wherein the first resilient member is configured to provide a biasing force to facilitate an electrical coupling of the first female electrode with only a first male connector electrode; and wherein the first female electrode comprises a first surface configured to make an electrical coupling with a male contact surface of a first male connector electrode; and wherein the first female electrode abuts an inner surface of the first female receptacle along at least a portion of a surface of the first female electrode.

34. The female electrical connector of claim 33, wherein the first surface extends in a direction substantially parallel to the direction of insertion of a first male connector electrode along substantially the entire length of at least one side of the first surface.

35. The female electrical connector of claim 33, wherein the first base member extends away from the first resilient contact member substantially along the direction of insertion of a first male connector electrode.

36. The female electrical connector of claim 33, wherein the first female electrode is configured to remain fixed relative to the first base member.

37. The female electrical connector of claim 33, wherein a first male connector electrode is secured within the first female receptacle by an interference fit without substantial deformation of a surface of a first male connector electrode.

38. The female electrical connector of claim 33, wherein at least a portion of the first base member is secured within the first female receptacle separately from the first female electrode such that the female housing electrically insulates the first base member from the first female electrode.

39. The female electrical connector of claim 33, wherein the first resilient member is retained within the female housing separately from the first female electrode, whereby a first male connector electrode is disposed between the first resilient member and the first female electrode when a first male connector electrode is inserted into the first female receptacle.

40. The female electrical connector of claim 33, further comprising an insulating member at least partially interposed between the first resilient member and a surface of a first male connector electrode when a first male connector electrode is at least partially inserted into the first female receptacle.

41. The female electrical connector of claim 33, wherein deformation of the first resilient contact member in response to interference from one or more portions of a first male connector electrode, when a first male connector electrode is at least partially inserted into within the first female receptacle, causes the first resilient member to extend in a direction substantially parallel to the direction of insertion of a first male connector electrode.

42. The female electrical connector of claim 33, wherein the first surface extends in a direction substantially parallel to the direction of insertion of a first male connector electrode to at least partially into the first female receptacle.

43. The female electrical connector of claim 33, wherein the first surface is disposed along a portion of the length of the first female electrode facing towards the first resilient member.

44. The female electrical connector of claim 33, wherein the first female electrode is configured to remain in a fixed position relative to a portion of the female housing while a male electrode is inserted to within the first female receptacle and moving from between a non-inserted to a fully inserted configuration.

45. The female electrical connector of claim 33, wherein the first resilient member is retained within the female housing spaced from the first female electrode, whereby the first resilient member and the first female electrode are not in contact with one another.

46. The female electrical connector of claim 45, wherein the first resilient member is not in contact with a male connector electrode unless and until a male connector electrode is at least partially inserted into within the first female receptacle.

47. The female electrical connector of claim 33, wherein the first female electrode further comprises one or more anchor portions extending from the first female electrode for securing the first female electrode against longitudinal movement relative to the female housing in at least one direction.

48. The female electrical connector of claim 47, wherein the first female electrode is configured to remain fixed relative to the female housing to prevent movement away from a first male connector electrode when a first male connector electrode is at least partially inserted into the first female receptacle between an unconnected configuration and a connected configuration.

49. The female electrical connector or claim 33, wherein a second end of the first resilient member is moveable within the first female receptacle upon deformation while a first male connector electrode is at least partially inserted into the first female receptacle.

50. The female electrical connector or claim 49, wherein the second end of the first resilient member slides along at least a portion of the wall of the first female receptacle upon deformation.

51. The female electrical connector of claim 50, wherein the second end of the first resilient member comprises a bend away from the at least a portion of the wall of the first female receptacle, with the bend facilitating sliding movement of the first resilient member along the at least a portion of the wall of the first female receptacle upon deformation.

52. The female electrical connector of claim 33, wherein the first female electrode comprises a plate of conductive material having a planar first surface.

53. The female electrical connector of claim 52, wherein the first female electrode further comprises a planar first female connector portion, and wherein the first surface is substantially co-planar with the first female connector portion.

54. The female electrical connector of claim 52, wherein the first surface is planar and aligned with the direction of insertion of a first male connector electrode.

55. The female electrical connector of claim 54, wherein the planar first surface extends substantially to the end of the first female electrode.

56. The female electrical connector of claim 33, further comprising:

the female housing comprising an insulating material at least partially forming a second female receptacle comprising a second receptacle opening for at least partially receiving a second male connector electrode, wherein the second female receptacle is configured to receive a second male connector electrode;

a second female electrode disposed at least partially within the second female receptacle;

a second resilient member retained by the second female receptacle, wherein the second resilient member comprises a second resilient contact member configured to provide an interference fit between the second female electrode and a second male connector electrode to secure the second female electrode and a second male connector electrode, when a second male connector electrode is at least partially inserted into the second female receptacle; and wherein the second resilient member further comprises a second base member fixed relative to a second portion of the female housing when a second male connector electrode is at least partially inserted into the second female receptacle between a non-inserted and fully inserted configuration; and wherein the second female electrode comprises a second surface configured to make an electrical coupling with a second male contact surface of a second male connector electrode.

57. The female electrical connector of claim 56, wherein at least one dimension of the first receptacle opening is larger than a corresponding dimension of the second receptacle opening.

58. The female electrical connector of claim 56, wherein the second resilient contact member is configured to deform while a second male connector electrode is at least partially inserted into the second female receptacle without any substantial deformation of the female housing;

wherein the second resilient member is configured to provide a biasing force to facilitate an electrical coupling of the second female electrode with only a second male connector electrode; and wherein the second female electrode comprises a second surface configured to make an electrical coupling with a male contact surface of a second male connector electrode, with the second surface disposed along a portion of the length of the second female electrode facing towards the second resilient member.

59. The female electrical connector of claim 56, wherein the female housing comprises a uniform insulating material.

* * * * *